US009104155B2

(12) United States Patent
Makino

(10) Patent No.: US 9,104,155 B2
(45) Date of Patent: Aug. 11, 2015

(54) IMAGE HEATING APPARATUS

(71) Applicant: CANON KABUSHIKI KAISHA, Tokyo (JP)

(72) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/834,122

(22) Filed: Mar. 15, 2013

(65) Prior Publication Data

US 2013/0266352 A1 Oct. 10, 2013

(30) Foreign Application Priority Data

Apr. 6, 2012 (JP) ..... 2012-087254

(51) Int. Cl.
*G03G 15/20* (2006.01)

(52) U.S. Cl.
CPC ..... *G03G 15/2085* (2013.01); *G03G 15/2017* (2013.01); *G03G 15/2025* (2013.01); *G03G 15/2028* (2013.01)

(58) Field of Classification Search
None
See application file for complete search history.

(56) References Cited

U.S. PATENT DOCUMENTS

| | | | | |
|---|---|---|---|---|
| 7,761,045 | B2 * | 7/2010 | Fujimori et al. | 399/329 |
| 8,977,172 | B2 * | 3/2015 | Yoshimura | 399/320 |
| 2002/0118982 | A1 * | 8/2002 | Fuma | 399/329 |

FOREIGN PATENT DOCUMENTS

| | | |
|---|---|---|
| JP | 2008-040363 A | 2/2008 |
| JP | 2010-107659 A | 5/2010 |

OTHER PUBLICATIONS

U.S. Appl. No. 13/834,601, filed Mar. 15, 2013, Youichi Chikugo.

* cited by examiner

*Primary Examiner* — Clayton E Laballe
*Assistant Examiner* — Jas Sanghera
(74) *Attorney, Agent, or Firm* — Canon USA Inc. IP Division

(57) ABSTRACT

If the positional relationship between the rubbing roller and the contact angle of the belt-like fixing member is changed by inclination of the steering roller, it is always possible for the rubbing roller to abut on the range where the belt-like fixing member is wrapped. As a result, it is possible to maintain uniform surface roughness for the fixing member surface layer, allowing the recording material to maintain evenness in the gloss.

18 Claims, 26 Drawing Sheets

FIG. 13

| POSITION OF FIXING BELT 105 | +3.0 mm | +1.0 mm | -1.0 mm | -3.0 mm |
|---|---|---|---|---|
| | DEPTH | | FRONT | |
| | APPARATUS STOPPED | ANGLE CHANGING POSITION | ANGLE CHANGING POSITION | APPARATUS STOPPED |
| FIRST SENSOR 150a | OFF | ON | OFF | OFF |
| SECOND SENSOR 150b | OFF | ON | ON | OFF |
| ROTATIONAL DIRECTION OF STEPPING MOTOR AT THE TIME OF DETECTION | — | CW | CCW | — |
| STEERING ROLL ANGLE | -2 | -2 | 2 | 2 |

IMAGE HEATING APPARATUS

BACKGROUND OF THE INVENTION

1. Field of the Invention

The present disclosure relates to an image heating apparatus for heating a toner image on a sheet. This image heating apparatus can be used in an image forming apparatus such as a copying machine, a printer, a facsimile apparatus, and a multifunction machine endowed with a plurality of functions of these machines.

2. Description of the Related Art

Conventionally, a fixing device (image heating apparatus) configured to fix a toner image to a recording material (sheet) has been mounted in an image forming apparatus utilizing electrophotography or the like.

Japanese Patent Application Laid-Open No. 2010-107659 discusses a fixing device using an endless fixing belt. In the case where such a fixing belt is used, there is a fear that a phenomenon will occur in which the fixing belt is deviated in the width direction thereof. In view of this, in the fixing device discussed in Japanese Patent Application Laid-Open No. 2010-107659, in order that the running range of the fixing belt may not be deviated from the normal zone, a steering roller (supporting roller) supporting the fixing belt is displaced, whereby the fixing belt is caused to remain within the normal zone.

On the other hand, Japanese Patent Application Laid-Open No. 2008-040363 discusses the problem of generation of uneven gloss in a fixed image, which is attributable to a state in which a part of the outer surface of the fixing roller has become more roughened than the other portion thereof as a result of repeated fixing process on a large number of recording materials. In view of this, in the device as discussed in the document described above, the outer surface of the fixing roller is rubbed by a rubbing roller, whereby the surface roughness of the outer surface of the fixing roller is made substantially uniform in the longitudinal direction thereof.

In this connection, the present inventor examined a configuration in which a rubbing roller is arranged, with a support roller supporting the fixing belt from the inner surface being used as an opposing member, and in which a steering roller is displaced such that the running range of the fixing belt remains within the normal zone, finding out the fact that the configuration involves the following problem.

More specifically, as the steering roller is displaced, the path of the fixing belt is changed. As a result of this change in the path of the fixing belt, a part of the fixing belt moves away from the support roller functioning as the opposing member of the rubbing roller. The present inventor has found out that when the rubbing roller is brought into contact with this part, there is involved variation in the longitudinal direction of the pressure distribution of the rubbing roller with respect to the fixing belt, which means there is a fear of the fixing belt becoming incapable of being properly rubbed.

SUMMARY OF THE INVENTION

The present disclosure is directed to an image heating apparatus capable of rubbing the endless belt more properly by the rubbing roller.

Further, the present disclosure is directed to an image heating apparatus capable of suppressing generation of unevenness in gloss in the image due to a part of an outer surface of the endless belt becoming more roughened than the other portion thereof.

According to an aspect disclosed herein, an image heating apparatus includes an endless belt configured to heat a toner image on a sheet at a nip portion, a first supporting roller and a second supporting roller configured to rotatably support an inner surface of the endless belt, a rotary member configured to form the nip portion in cooperation with the endless belt, a displacing mechanism configured to displace the first supporting roller so the endless belt is within a predetermined zone in a width direction of the endless belt, and a rubbing roller configured to rub an outer surface of the endless belt at a rubbing position where the rubbing roller causes the endless belt to be brought into press contact with the second supporting roller, wherein the rubbing position is a position that avoids a region where the endless belt is separated from the second supporting roller with a displacement of the first supporting roller.

According to another aspect disclosed herein, an image heating apparatus includes an endless belt configured to heat a toner image on a sheet at a nip portion, a first supporting roller and a second supporting roller configured to rotatably support an inner surface of the endless belt, a rotary member configured to form the nip portion in cooperation with the endless belt, a displacing mechanism configured to displace the first supporting roller so the endless belt is within a predetermined zone in a width direction of the endless belt, and a rubbing roller configured to rub an outer surface of the endless belt at a rubbing position where the rubbing roller causes the endless belt to be brought into press contact with the second supporting roller, wherein the rubbing position is a position in a region where the endless belt is supported by the second supporting roller irrespective of a displacement operation of the first supporting roller.

According to yet another aspect disclosed herein, an image heating apparatus includes an endless belt configured to heat a toner image on a sheet at a nip portion, a first supporting roller and a second supporting roller configured to rotatably support an inner surface of the endless belt, a rotary member configured to form the nip portion in cooperation with the endless belt, a displacing mechanism configured to displace the first supporting roller in a predetermined range between a first position to a second position so that the endless belt is within a predetermined zone in a width direction of the endless belt, a rubbing roller configured to rub an outer surface of the endless belt at a rubbing position where the rubbing roller causes the endless belt to be brought into press contact with the second supporting roller and a moving mechanism configured to move the rubbing roller between the rubbing position and a separation position where the rubbing roller is separated from the endless belt, wherein the rubbing position is a position that avoids a region where the endless belt is separated from the second supporting roller in a case where the first supporting roller is in the first position and the second position in a state where the rubbing roller is in the separation position.

According to yet another aspect disclosed herein, an image heating apparatus includes an endless belt configured to heat a toner image on a sheet at a nip portion, a first supporting roller and a second supporting roller configured to rotatably support an inner surface of the endless belt, a rotary member configured to form the nip portion in cooperation with the endless belt, a displacing mechanism configured to displace the first supporting roller in a predetermined range from a first position to a second position so that the endless belt is within a predetermined zone in a width direction of the endless belt, and a rubbing roller configured to rub an outer surface of the endless belt at a rubbing position where the rubbing roller causes the endless belt to be brought into press contact with the second supporting roller, wherein the rubbing position is a position in a region where the endless belt is supported by the second supporting roller in a case where the first supporting roller is in the first position and the second position in a state where the rubbing roller is in the separation position.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles described herein.

FIG. 13 is a flowchart illustrating fixing belt deviation control.

DESCRIPTION OF THE EMBODIMENTS

Various exemplary embodiments, features, and aspects of the disclosure will be described in detail below with reference to the drawings.

Unless otherwise specified, it goes without saying that the configurations described below may be replaced by other well-known configurations without departing from the scope of the gist of the present invention.

The first exemplary embodiment will be described.

Image Forming Apparatus

Figure 2:
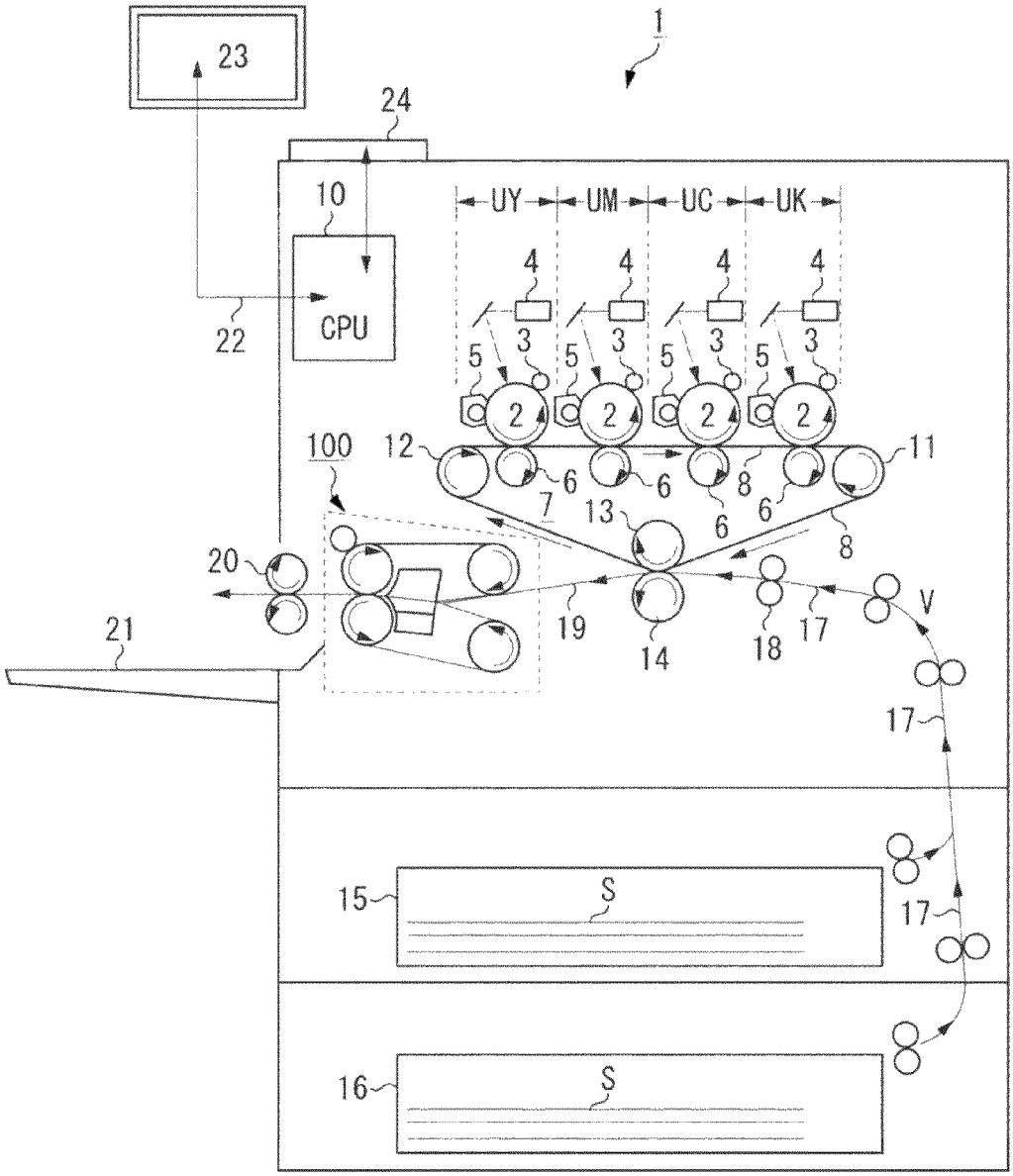
FIG. 2 is a sectional view for illustrating an image forming apparatus according to the first exemplary embodiment.

FIG. 2 is a schematic diagram illustrating the configuration of an image forming apparatus 1 according to the present exemplary embodiment. It is a schematic sectional view taken along the conveyance direction V for a recording material (hereinafter referred to as the sheet) S. This image forming apparatus 1 is an intermediate transfer in-line type four full-color electrophotographic printer (hereinafter referred to as the printer). This printer 1 can form on the sheet S an image corresponding to image data (electrical image information) input to a printer control unit (hereinafter referred to as the central processing unit (CPU)) 10 from an external host apparatus 23 connected via an interface 22, and can output an image product.

The CPU 10 is a control unit collectively controlling the operation of the printer 1. It performs exchange of various electric signals between itself and the external host apparatus 23, a printer operation unit 24, etc. Further, performs the processing of electrical information signals input from various process apparatuses and sensors, the processing of command signals to be issued to the various process apparatuses, predetermined initial sequence control, and predetermined image formation sequence control. The external host apparatus 23 includes a personal computer, a network, an image reader, a facsimile apparatus or the like.

Inside the printer 1, first through fourth image forming units U (UY, UM, UC, and UK) are provided side by side from the left-hand side to the right-hand side. The image forming units U are an electrophotographic image forming mechanism having same configuration except that they respectively contain toners of different colors in their respective developing devices 5: yellow (Y), magenta (M), cyan (C), and black (K).

That is, each image forming unit U has an electrophotographic photosensitive drum (hereinafter referred to as the drum) 2, a charging roller 3 as a processing unit acting on this drum 2, a laser scanner 4, a developing device 5, a primary transfer roller 6, etc.

The drum 2 of each image forming unit U is rotationally driven at a predetermined speed counterclockwise as indicated by the arrow. And, a Y-color toner image corresponding to the Y-color component of the full color image to be made is formed on the drum 2 of the first image forming unit UY. An M-color toner image corresponding to the M-color component is formed on the drum 2 of the second image forming unit UM. A C-color toner image corresponding to the C-color component is formed on the drum 2 of the third image forming unit UC. A K-color toner image corresponding to the K-color component is formed on the drum 2 of the fourth image forming unit UK. The process/principle of the toner image formation on the drum 2 of each image forming unit U is based on the well-known technique, so a description thereof will be left out.

An intermediate transfer belt unit 7 is arranged under the respective image forming units U. This unit 7 has a flexible endless intermediate transfer belt 8 as a second image bearing member. The belt 8 is wrapped around and stretched between three rollers: a drive roller 11, a tension roller 12, and a secondary-transfer counter roller 13. By driving the drive roller 11, the belt 8 is circulated clockwise at a speed corresponding to the rotational speed of the drums 2. A secondary transfer roller 14 is brought into contact with the secondary-transfer counter roller 13 via the belt 8 with a predetermined pressing force. The abutment portion between the belt 8 and the secondary transfer roller 14 is a secondary transfer nip portion.

Primary transfer rollers 6 of the image forming units U are arranged on the inner side of the belt 8, with each of them abutting on the lower surface of the drum 2 via of the belt 8. At each image forming unit U, the abutment portion between the drum 2 and the belt 8 constitutes a primary transfer nip portion. A predetermined primary transfer bias is applied to each primary transfer roller 6 with predetermined control timing.

The Y-color toner image, the M-color toner image, the C-color toner image, and the K-color toner image respectively formed on the drums 2 of the image forming units U are sequentially superimposed one upon the other on the surface of the circulating belt at the primary transfer nip portions. As a result, a four full-color unfixed toner image is synthesized and formed on the belt 8 to be conveyed to the secondary transfer nip portion.

On the other hand, one sheet S accommodated in a first or a second sheet feeding cassette 15 or 16 is separated and fed through the operation of a feeding mechanism, and is sent to a registration roller pair 18 through a conveyance path 17. The registration roller pair 18 temporarily receives the sheet S, rectifying it when is being skew-fed. And, in synchronism with the toner image on the belt 8, the registration roller pair 18 conveys the sheet S to the secondary transfer nip portion.

While the sheet S is being nipped and conveyed at the secondary nip portion, a predetermined secondary transfer bias is applied to the secondary transfer roller 14. As a result, the full-color toner images on the belt 8 side undergo collective, successive secondary transfer to the sheet S. And, the sheet S having left the secondary transfer nip portion is separated from the surface of the belt 8, passes through a conveyance path 19, and is introduced into an image heating/fixing apparatus 100 as an image processing apparatus. At the fixing apparatus 100, the sheet S is heated and pressurized, whereby the unfixed toner images are fixed as stationary images. After leaving the fixing apparatus 100, the sheet S is conveyed to a discharge tray 21 as a full-color image product by a discharge roller pair 20, and is discharged.

Fixing Apparatus 100

Figure 3:
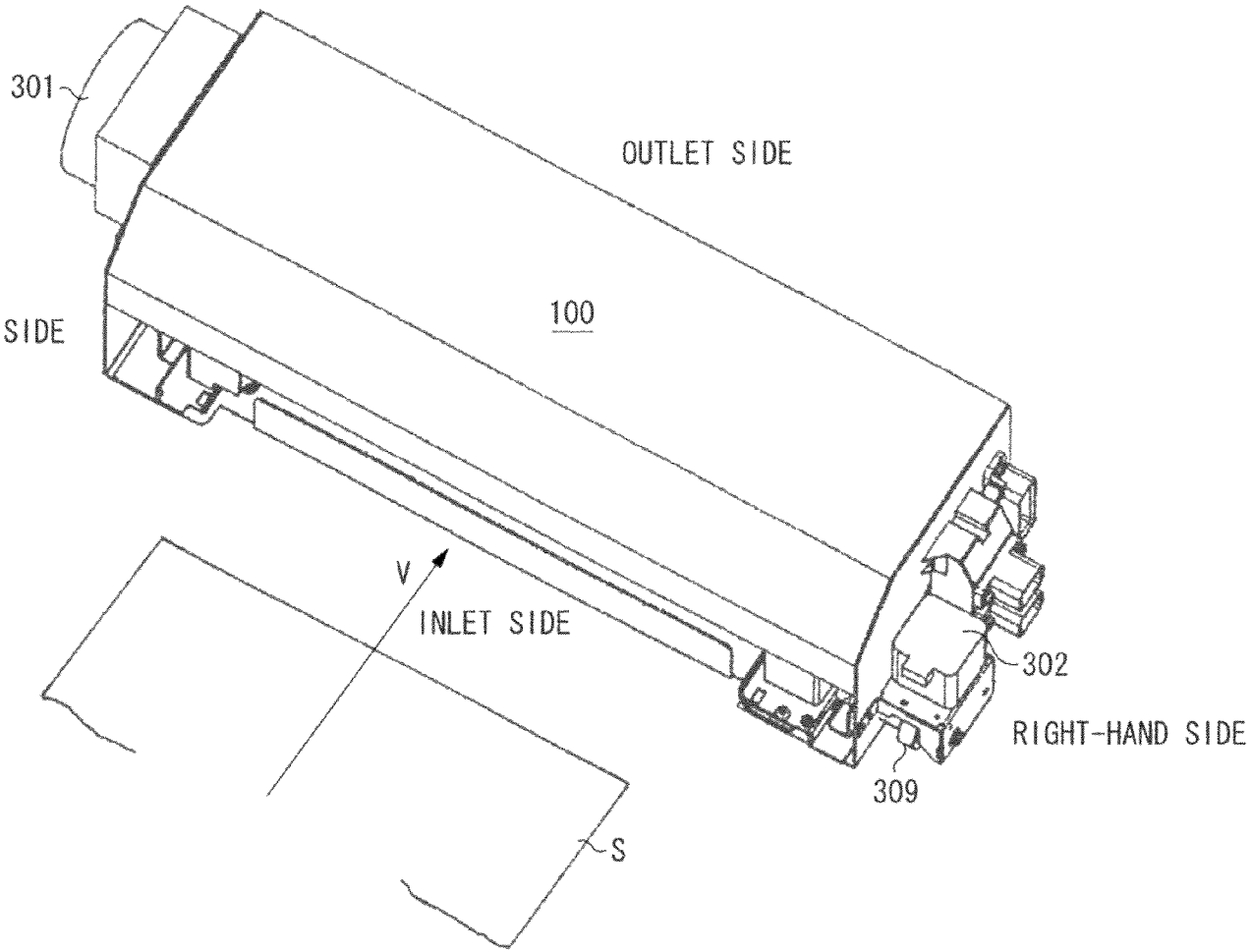
FIG. 3 is an outward perspective view of the fixing device according to the first exemplary embodiment.
Figure 4:
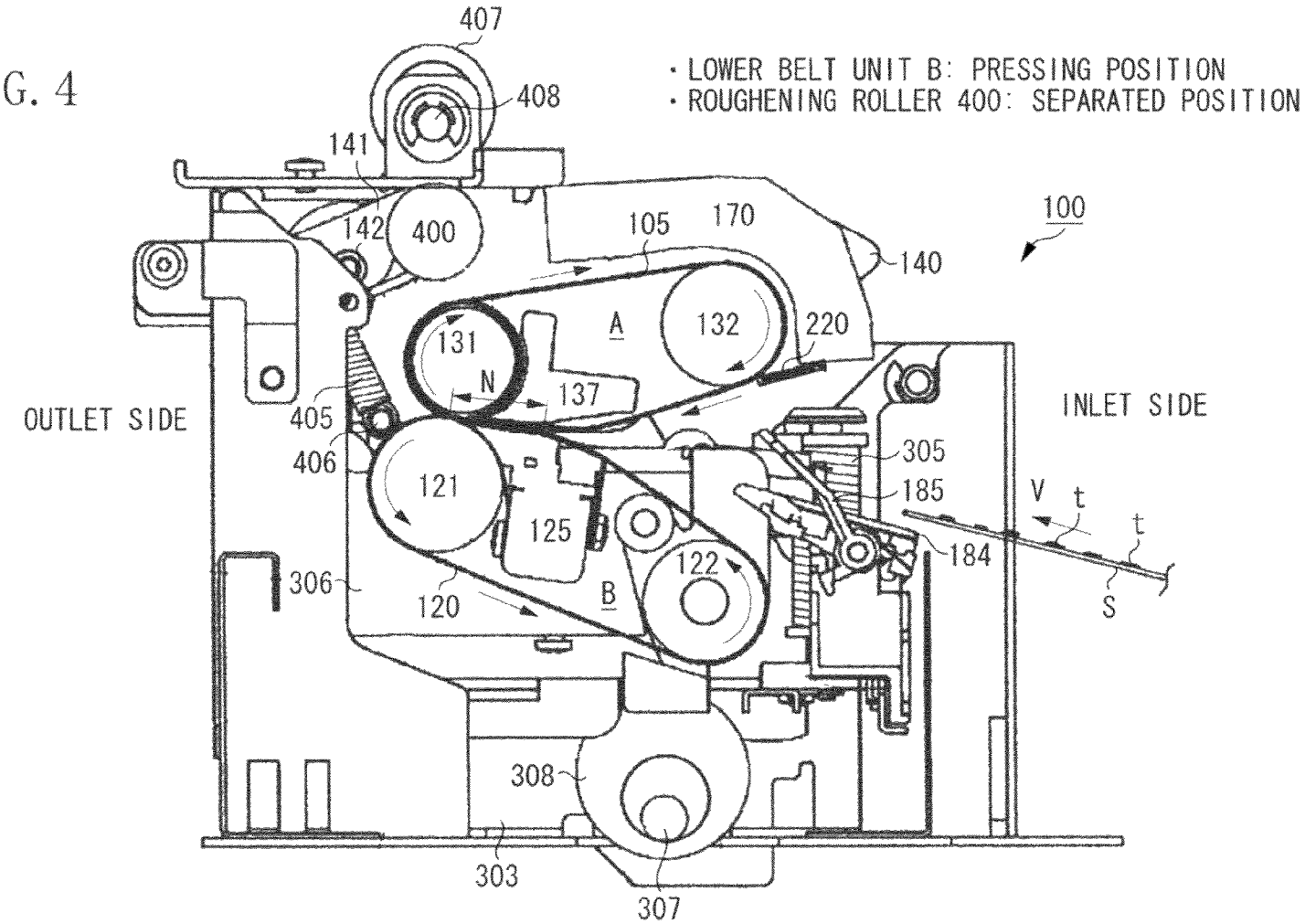
FIG. 4 is a right-hand side cross-sectional view of a main portion of the fixing device (with a lower belt assembly B in a pressing state).
Figure 5:
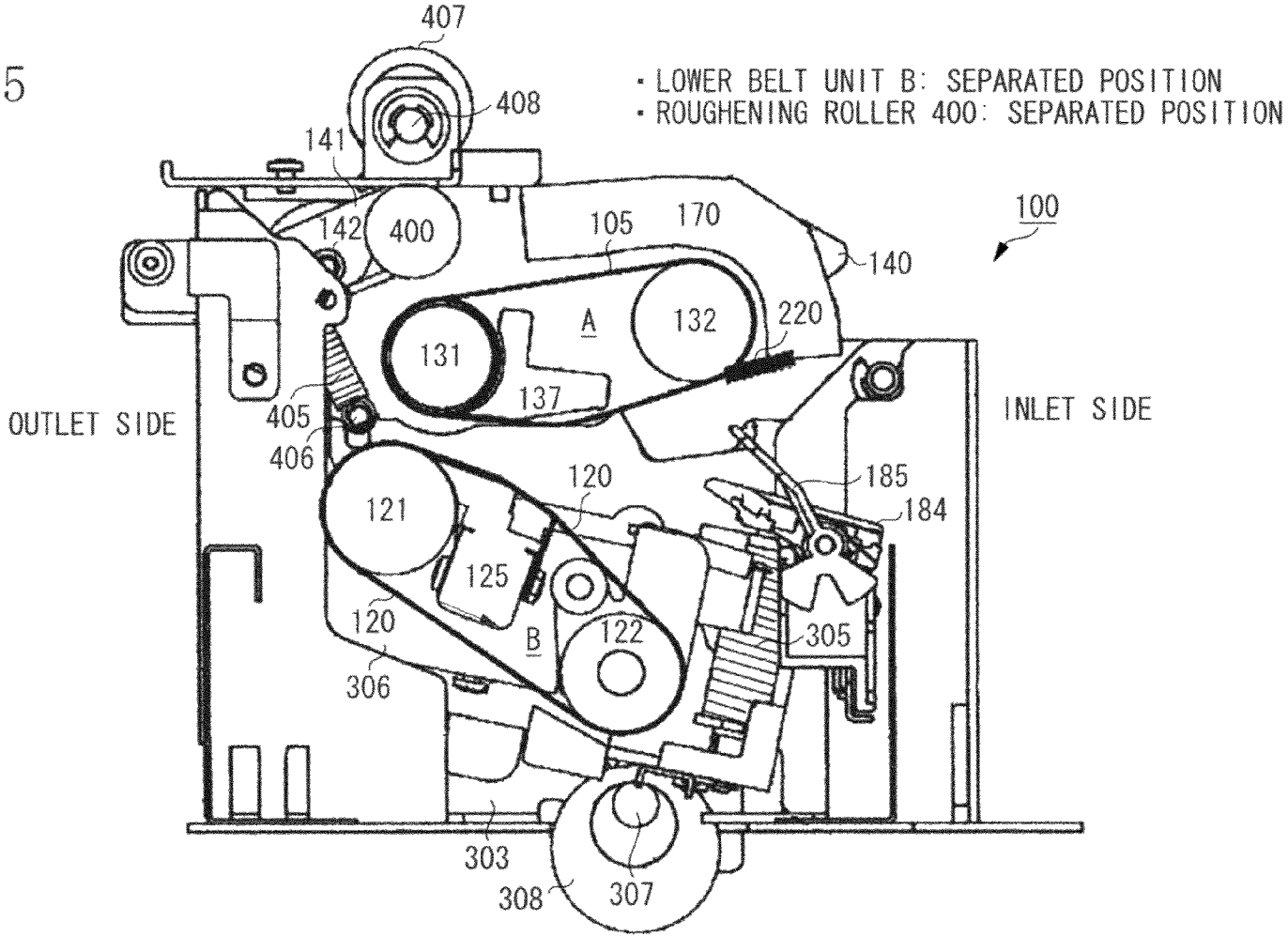
FIG. 5 is a left-hand side view of the main portion of the fixing device (with the lower belt assembly B in the pressing state).
Figure 6:
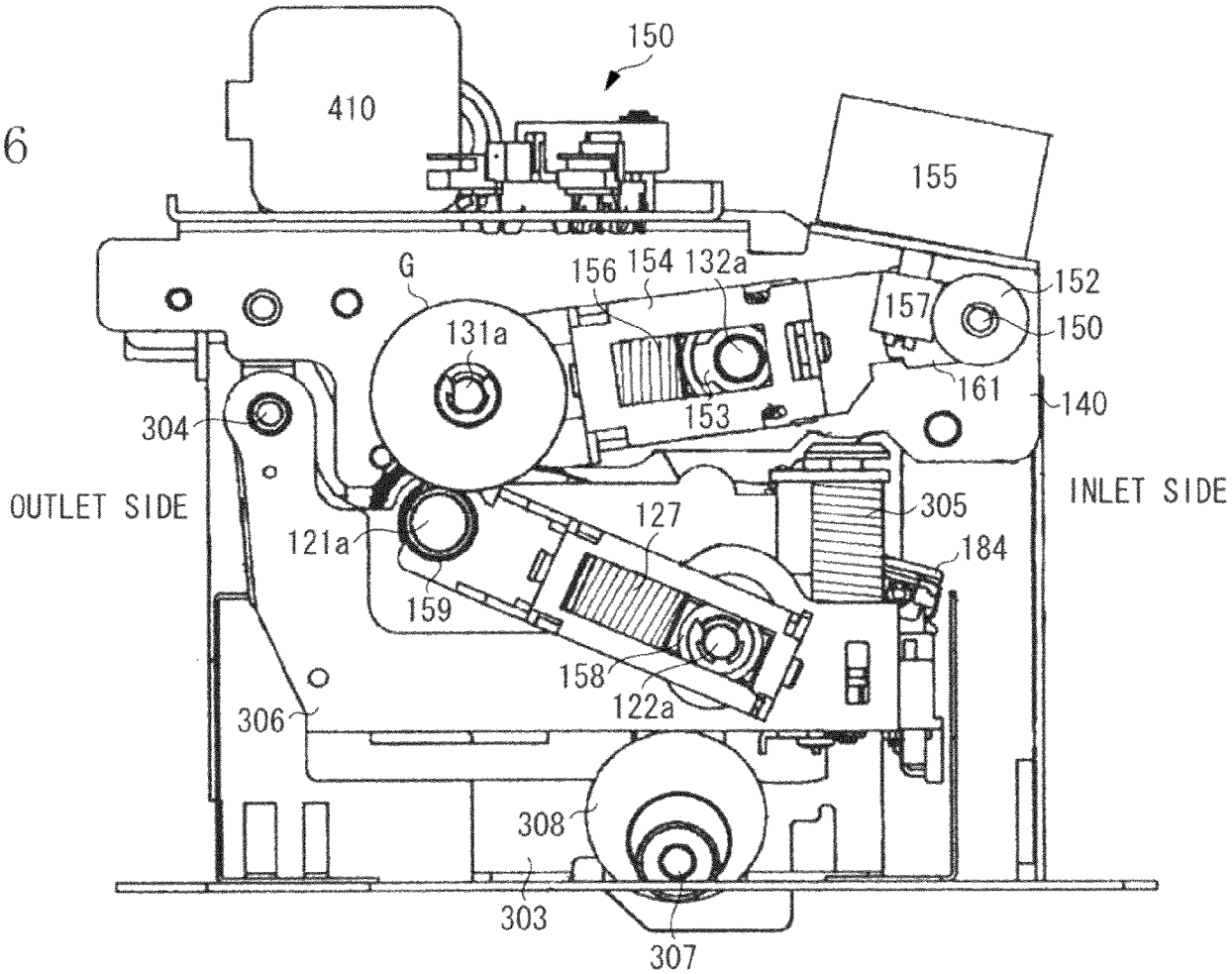
FIG. 6 is a left-hand side view of the main portion of the fixing device (with the lower belt assembly B in the pressing state).
Figure 7:
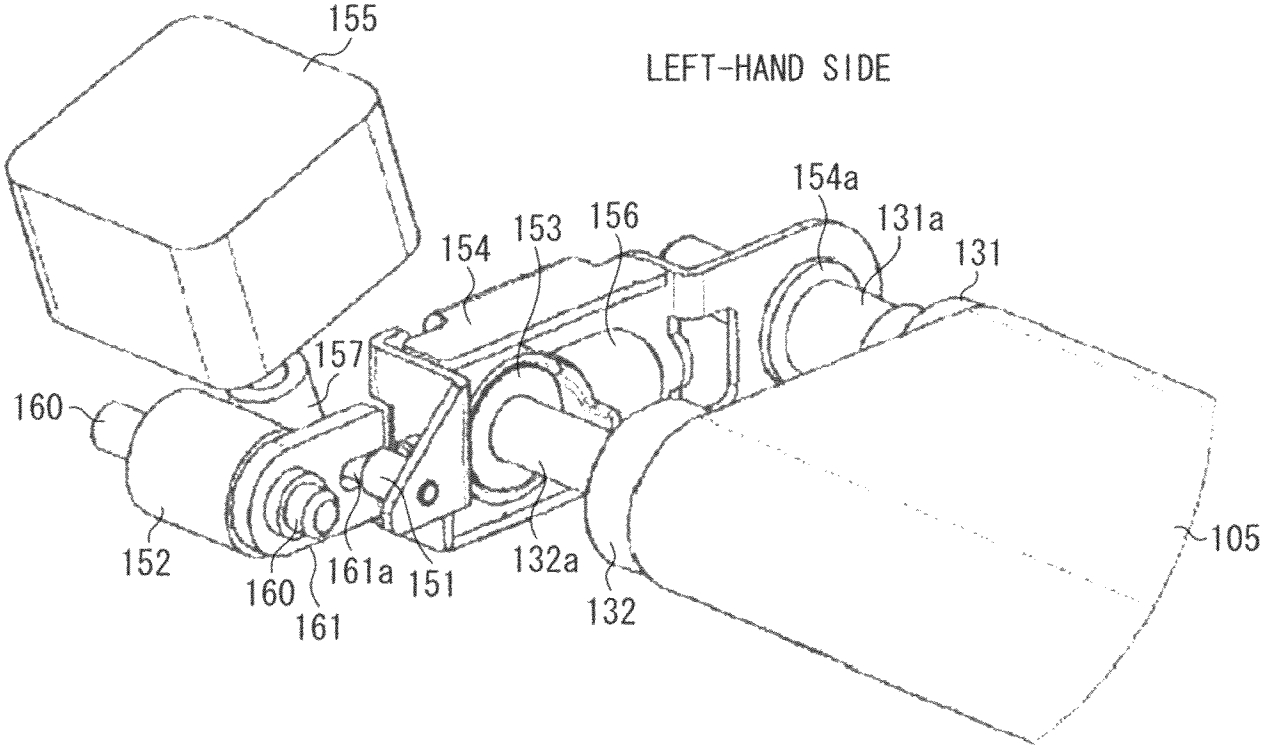
FIG. 7 is an explanatory view of a displacing mechanism of a steering roller.

FIG. 3 is an outward perspective view of the fixing apparatus 100 functioning as an image heating apparatus. FIG. 4 is a right-hand side cross-sectional view of a main portion of the same apparatus 100, illustrating the lower belt assembly B in pressing state. FIG. 5 is a right-hand side cross-sectional view of a main portion of the same apparatus 100, illustrating the lower belt assembly B in pressurization releasing state. FIG. 6 is a left-hand side view of the main portion of the same device, illustrating it in the state in which the lower belt assembly B is being pressed. FIG. 7 is a perspective view of a belt deviation control mechanism portion.

With respect to the fixing apparatus 100 or the members constituting the same, the longitudinal direction or the width direction refers to a direction parallel to a direction orthogonal to the conveyance direction V for the sheet S in the sheet conveyance path plane. The widthwise direction refers to a direction parallel to the conveyance direction V for the sheet S in the sheet conveyance path plane.

Further, regarding the fixing apparatus 100, the front face is the surface on the sheet inlet side, the back face is the surface on the sheet outlet side, and the right and left refers to the left-hand or right-hand side as seen from the front side of the apparatus. In the present exemplary embodiment, the left-hand side is referred to as the front side, and the right-hand side is referred to as the rear side. The terms up and down refer to the up and down in the direction of the gravitational force. The terms upstream and downstream refer to the upstream and downstream with respect to the conveyance direction V for the sheet S. The width of the belt or of the sheet is the dimension in a direction orthogonal to the sheet conveyance direction.

The fixing apparatus 100 as the image processing apparatus according to the present exemplary embodiment is a belt-nip type, an electromagnetic induction heating (IH) type, or an oil-less fixing type image heating apparatus.

This fixing apparatus 100 includes an upper belt assembly A as the heating unit, and a lower belt assembly B as the pressure unit. Further, it has a pressing/separation mechanism (abutment/separation unit) for the lower belt assembly B with respect to the upper belt assembly A. Further, it has an IH heater (magnetic flux generation unit) 170 serving as a heating unit for heating the fixing belt 105 in the upper belt assembly A, a roughening mechanism (surface property recovery mechanism) for substantially recovering the surface property of the fixing belt 105, etc. In the following, these will be described one by one.

(2-1) Upper Belt Assembly A and IH Heater 170

The upper belt assembly A is arranged between the right and left upper side-plates 140 of the apparatus casing. This assembly A includes a flexible fixing belt 105, having a releasing layer on the surface thereof, as a heating rotary member (endless belt) opposite to the image bearing surface of the sheet S. Further, the assembly A includes a plurality of supporting rollers rotatably supporting the fixing belt 105 and a pad stay 137. The plurality of supporting rollers includes a drive roller (rotary member, fixing roller) 131, and a steering roller (steering rotary member) 132 also serving as a tension roller.

The drive roller 131 is arranged on the sheet outlet side between the right and left upper side-plates 140, and right and left shaft portions 131*a* are respectively rotatably supported between the right and left upper side-plates 140 via bearings (not illustrated).

On the outer side of the right and left upper side-plates 140, steering roller supporting arms 154 extending from the drive roller 131 side toward the sheet inlet side are respectively arranged. The right-hand side supporting arm 154 (not illustrated) is fixed to the right-hand side upper side-plate 140 (not illustrated). Referring to FIG. 7, the left-hand side supporting arm 154 is supported with respect to the left-hand side shaft 131*a* of the drive roller 131 via the bearing 154*a*, and is vertically swingable around the shaft 131*a*. A pin 151 is implanted in a free end portion of the left-hand side supporting arm 154. Further, a shaft 160 is implanted on the sheet inlet side of the outer surface of the left-hand side upper side-plate 140.

A worm wheel (helical gear) 152 integrally provided with a fork plate 161 having a U-shaped groove portion 161*a* is rotatably supported with respect to this shaft 160. And, the pin 151 of the left-hand side supporting arm 154 is engaged with the groove portion 161*a* of the fork plate 161. A stepping motor 155 is arranged on the upper side-plate 140. A worm 157 firmly attached to the rotation shaft of this motor 155 is in mesh with the worm wheel 152.

The stepping motor 155 is rotationally driven for normal rotation or reverse rotation, whereby the fork plate 161 is rotated upwards or downwards via the worm 157 and the worm wheel 152. In conjunction with this, the left-hand side supporting arm 154 rotates upwards or downwards around the shaft 131*a*.

A steering roller 132 is arranged on the sheet inlet side between the right and left upper side-plates 140, and right and left shaft portions 132*a* are rotatably supported with respect to the right and left supporting arms 154 via a bearing 153. The bearing 153 is supported so as to be slidable in the belt tension direction with respect to the supporting arm 154, and is urged by a tension spring 156 so as to move away from the drive roller 131.

A pad stay 137 is a member formed, for example, of stainless steel (SUS material). The right and left end portions of the pad stay 137 are fixedly supported between the right and left upper side-plates 140, with the pad receiving surface facing downwards, on the inner side of the fixing belt 105 and between the drive roller 131 and the steering roller 132 so as to be nearer to the drive roller 131.

A predetermined tension is applied, through movement in the belt tension direction of the steering roller 132 due to the urging force of the tension spring 156, to the fixing belt 105 stretched between the drive roller 131, the steering roller 132, and the pad stay 137. In the present exemplary embodiment, a tension of 200 N is applied. The inner surface of the lower side belt portion of the fixing belt 105 is brought into contact with the downwardly facing pad receiving surface of the pad stay 137.

The material of the fixing belt 105 may be selected as appropriate so long as it is configured to generate heat by the IH heater 170 and is endowed with heat resistance. For example, it is possible to employ a belt obtained by covering a magnetic metal layer such as a nickel metal layer or a stainless steel layer having a thickness of 75 μm, a width of 380 mm, and a peripheral length of 200 mm with, for example, a silicone rubber layer having a thickness of 300 μm, and covering the surface layer (releasing layer) with a perfluoroalkoxy fluororesin (PFA) tube.

The drive roller 131 includes, for example, a roller in which a heat resistant silicone rubber elastic layer is formed by casting on a surface of a core of solid stainless steel having an outer diameter of ϕ18. The drive roller 131 is arranged on the sheet outlet side of the nip region of a fixing nip portion formed by the fixing belt 105 and a pressure belt 120 as a second rotary member described below, with the elastic layer being elastically distorted by a predetermined amount in press contact with a pressure roller 121 described below.

In the present exemplary embodiment, the nip portion formed by pinching the fixing belt and the pressure belt 120 by the drive roller 131 and the pressure roller 121 is of a substantially straight configuration. However, to control the buckling of the sheet S due to a difference in the speed of the sheet S in the fixing nip portion N, it is also possible to adopt various crown configurations for the rollers, i.e., the drive roller 131 and the pressure roller 121. For example, the rollers may be intentionally formed in a reverse-crown configuration.

The steering roller 132 is a hollow roller formed, for example, of stainless steel having an outer diameter of approximately ϕ20 and an inner diameter of approximately ϕ18. This steering roller 132 functions as a tension roller configured to stretch the fixing belt 105 to impart tension thereto, and as a steering roller configured to adjust, through inclination control by a deviation control mechanism described below, the meandering in the width direction orthogonal to the moving direction of the fixing belt 105.

A drive input gear G is coaxially fixed to the left end side of the roller shaft 131*a* of the drive roller 131. Drive is input to this gear G from a drive motor 301 (FIG. 3) via a drive transmission unit (not illustrated), and the drive roller 131 is rotated clockwise as indicated by the arrow in FIG. 4 at a predetermined speed.

By the rotation of this drive roller 131, the fixing belt 105 is circularly conveyed clockwise as indicated by the arrow at a speed corresponding to the speed of the drive roller 131. The steering roller 132 is rotatably driven by the circularly conveyance of the belt 105. The inner surface of the lower side belt portion of the fixing belt 105 moves while being in sliding contact with the downwardly facing pad receiving surface of the pad stay 137. To convey the sheet S in a stable manner at the fixing nip portion N described below, drive is reliably transmitted between the fixing belt 105 and the drive roller 131.

The IH heater 170 as the heating unit for heating the fixing belt 105 is an induction heating coil unit formed by an excitation coil, a magnetic member core, a holder holding them, etc. It is arranged on the upper side of the upper belt assembly A, and is fixedly arranged between the right and left upper side-plates 140 while being opposite to the fixing belt 105 in a non-contact fashion at a predetermined interval from the upper surface portion of the fixing belt 105 to the steering roller 132 portion.

By supplying an alternating current, the excitation coil of the IH heater 170 generates an AC magnetic flux, which is guided to a magnetic body core to generate an eddy current in the magnetic metal layer of the fixing belt 105, which is an induction heat generation member. The eddy current generates Joule heat due to the specific resistance of the induction heat generation member. The alternating current supplied to the excitation coil performs temperature control of the surface temperature of the fixing belt 105 to approximately 140° C. to 200° C. (target temperature) based on temperature information from a thermistor 220 for detecting the surface layer temperature of the fixing belt 105.

(2-2) Lower Belt Assembly B and Pressing-Separation Mechanism (Moving Mechanism)

The lower belt assembly B is arranged on the lower side of the upper belt assembly A. This assembly B is mounted to a lower frame (pressure frame) 306 supported so as to be vertically rotatable around a hinge shaft 304 fixedly provided on right and left lower side-plates 303 on the sheet outlet side of the fixing apparatus 100.

This assembly B includes a flexible endless pressure belt (endless belt) 120 as an opposing member (pressure rotatable member: pressure member) forming the nip portion N together with the fixing belt 105 on the upper belt assembly A side. Further, the assembly B includes a pressure roller 121, a tension roller 122, and a pressure pad 125 as a plurality of belt suspension members for suspending the pressure belt 120 with tension.

Right and left shaft portions 121*a* of the pressure roller 121 are respectively rotatably supported by right and left side-plates of a lower frame 306 via bearings 159. Right and left shaft portions 122*a* of the tension roller 122 are respectively rotatably supported by the right and left side-plates of the lower frame 306 via bearings 158. The bearings 158 are supported so as to be slidable in the belt tension direction with respect to the lower frame 306, and are urged so as to move away from the pressure roller 121 by a tension spring 127.

The pressure pad 125 is a member formed, for example, of silicone rubber, and the right and left end portions thereof are fixedly supported between the right and left side-plates of the lower frame 306. The pressure roller 121 is situated on the sheet outlet side between the right and left side-plates of the lower frame 306. The tension roller 122 is situated on the sheet inlet side between the right and left side-plates of the lower frame 306. The pressure pad 125 is arranged on the inner side of the pressure belt 120 between the pressure roller 121 and the tension roller 122 so as to be nearer to the pressure roller 121 while being supported in a non-rotatable fashion, with its pad surface facing upwards.

By the movement in the belt tension direction of the tension roller 122 due to the urging force of the tension spring 127, a predetermined tension is applied to the pressure belt 120 stretched between the pressure roller 121, the tension roller 122, and the pressure pad 125. In the present exemplary embodiment, a tension of 200 N is applied. The inner surface of the upper side belt portion of the pressure belt 120 is brought into contact with the upwardly facing pad surface of the pressure pad 125.

The material of the pressure belt 120 may be selected as appropriate so long as it is endowed with heat resistance. For example, it is possible to employ a belt obtained by covering a nickel metal layer having a thickness of 50 μm, a width of 380 mm, and a peripheral length of 200 mm with, for example, a silicone rubber layer having a thickness of 300 μm, and covering the surface layer (releasing layer) with a PFA tube. The pressure roller 121 is formed, for example, as a solid stainless steel roller having an outer diameter of ϕ20. The tension roller 122 is formed, for example, as a hollow stainless steel roller in an outer diameter of approximately ϕ20 and an inner diameter of approximately ϕ10.

The lower belt assembly B is vertically rotation-controlled around a hinge shaft 304 by a pressing-separation mechanism as an abutment/separation unit. Specifically, the lower belt assembly B is lift-up-rotated by the pressing-separation mechanism to be thereby moved to the pressing position as illustrated in FIG. 4. Further, it is lift-down-rotated to be moved to the separation position as illustrated in FIG. 5.

The lower belt assembly B is moved to the pressing position, whereby the pressure roller 121 and the pressure pad 125 are respectively brought into press contact, with a predetermined pressing force, with the drive roller 131 and the pad stay 137 of the upper belt assembly A, while pinching the pressure belt 120 and the fixing belt 105. As a result, a fixing nip portion N of a predetermined width is formed in the conveyance direction V for the sheet S between the fixing belt 105 of the upper belt assembly A and the pressure belt 120 of the lower belt assembly B. Further, the lower belt assembly B is moved to the separation position, whereby the pressure is released with respect to the upper belt assembly A to allow the lower belt assembly B to be separated in a non-contact fashion.

The pressing-separation mechanism according to the present exemplary embodiment will be described. A pressure spring unit having a pressure spring 305 for elastically bringing the lower belt assembly B into press contact with the upper belt assembly A is arranged on the lower frame 306 on the side opposite the hinge shaft 304 side.

A pressure cam shaft 307 is arranged on the lower portion between the right and left lower-plates 303 while being rotatably borne. A pair of eccentric pressure cams 308 of the same configuration and the same phase supporting the lower surface of the lower frame 306 are fixedly arranged respectively on the right and left sides of the pressure cam shaft 307. A pressure gear 309 (FIG. 3) is arranged coaxially and fixedly at the right-hand end side of the pressure cam shaft 307. Drive is input to this gear 309 from the pressure motor 302 via a drive transmission unit (not illustrated), and the pressure cam shaft 307 is rotated.

With respect to the eccentric pressure cams 308, the pressure cam shaft 307 is rotation-controlled to a first rotation angle position where a large bulge portion faces upwards as illustrated in FIGS. 4 and 6, and to a second rotation angle position where the large swollen portion faces downwards.

The pressure cam shaft 307 is rotated to and stopped at the first rotation angle position, whereby the lower frame 306 on which the lower belt assembly B is mounted is lifted by the large bulge portions of the eccentric pressure cams 308. Then, the lower belt assembly B abuts on the upper belt assembly A while pressing and contracting the pressure spring 305 of the pressure spring unit. As a result, the lower belt assembly B is pressed against and urged toward the upper belt assembly A elastically with a predetermined pressure (e.g., 400 N) due to the compressive reactive force of the pressure spring 305, and is retained at the pressing position of FIG. 4.

As a result of the press contact of the pressure roller 121 with the drive roller 131, the drive roller 131 undergoes warpage deformation by approximately several hundreds microns on the side opposite the direction in which it comes into contact with the pressure roller 121. This warpage deformation leads to depressurizing at the central portion in the longitudinal direction of the fixing nip portion N. To eliminate this depressurizing, the drive roller 131 or the drive roller 131 and the pressure roller 121 assume a crowned shape, whereby the nip formed by the drive roller 131 and the pressure roller 121 is formed in a substantially straight configuration. In the present exemplary embodiment, the drive roller 131 is provided with a positive crowned shape of 300 μm.

Further, the pressure cam shaft 307 is rotated to and stopped at the second rotation angle, whereby the large bulge portion of the eccentric pressure cams 308 is directed downwards, and the small bulge portion thereof conforms to the lower surface of the lower frame 306 to thereby lower the lower belt assembly B. Specifically, the pressure of the lower belt assembly B with respect to the upper belt assembly A is released, and the lower belt assembly is retained at the separation position as illustrated in FIG. 5, where it is separated in a non-contact fashion.

Figure 8A:
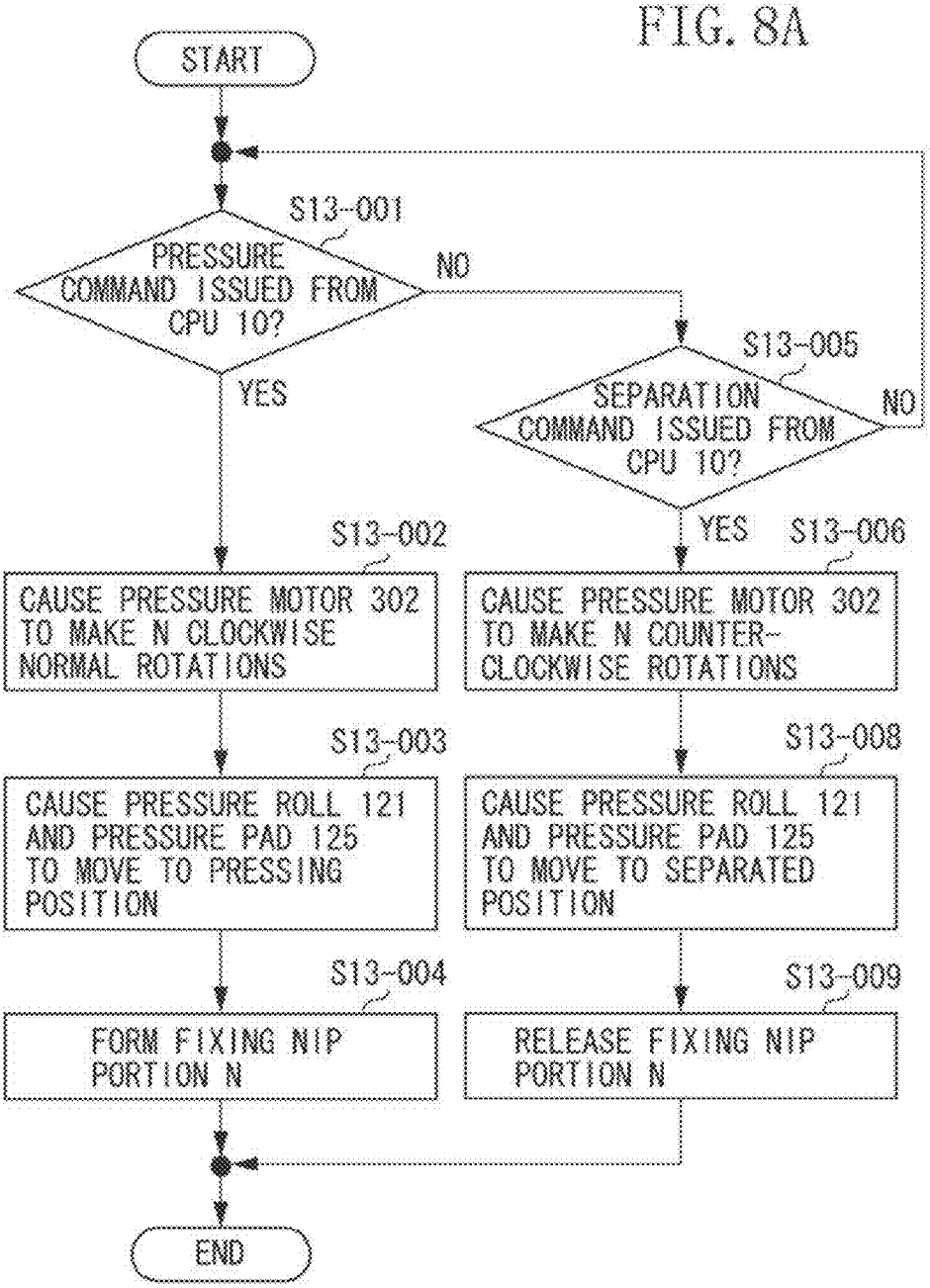
FIG. 8A is a flowchart illustrating fixing operation control for the fixing device.
Figure 8B:
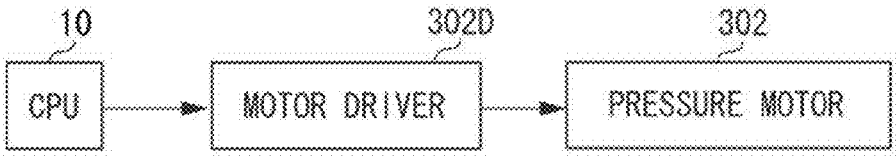
FIG. 8B is a block diagram illustrating the control system thereof.

The upward and downward movement control of the lower belt assembly B will be described with reference to the control flowchart of FIG. 8A and the control system block diagram of FIG. 8B.

Normally, the lower belt assembly B is retained at the separation position illustrated in FIG. 5. A pressure command is issued from the CPU 10 (YES in step S13-001), and, in step S13-002, the pressure motor 302 makes N rotations, which is a predetermined number of rotations, in the clockwise direction via motor driver 302D, whereby the pressure cam shaft 307 is driven to rotate by half. As a result, in step S13-003, the eccentric pressure cams 308 are converted from the second rotation angle position of FIG. 5 to the first rotation angle position of FIGS. 4 and 6, and the lower belt assembly B is lifted and rotated, and then the pressure roller 121 and the pressure pad 125 move to the pressing position.

Specifically, the pressure roller 121 and the pressure pad 125 are brought into press contact with the drive roller 131 and the pad stay 137 of the upper belt assembly A with a predetermined abutment pressure, while pinching the pressure belt 120 and the fixing belt 105. As a result, in step S13-004, the fixing nip portion N of a predetermined width is formed in the sheet conveyance direction V between the fixing belt 105 and the pressure belt 120.

Further, in the state in which the lower belt assembly B is retained at the pressing position in FIG. 4, a separation command is issued from the CPU 10 (YES in step S13-005), and, in step S13-006, the pressure motor 302 makes N rotations, which is predetermined number of rotations, in the counterclockwise direction. As a result, the pressure cam shaft 307 is driven to rotate by half, and the eccentric pressure cams 308 are converted to the second rotation angle position in FIG. 5 from the first rotation angle position in FIGS. 4 and 6. Specifically, in step S13-008, the lower belt assembly B is lowered and rotated, and the pressure roller 121 and then the pressure pad 125 move to the separated position. As a result, in step S13-009, the formation of the fixing nip portion N is released.

(2-3) Fixing Operation and Temperature Control

Figure 9A:
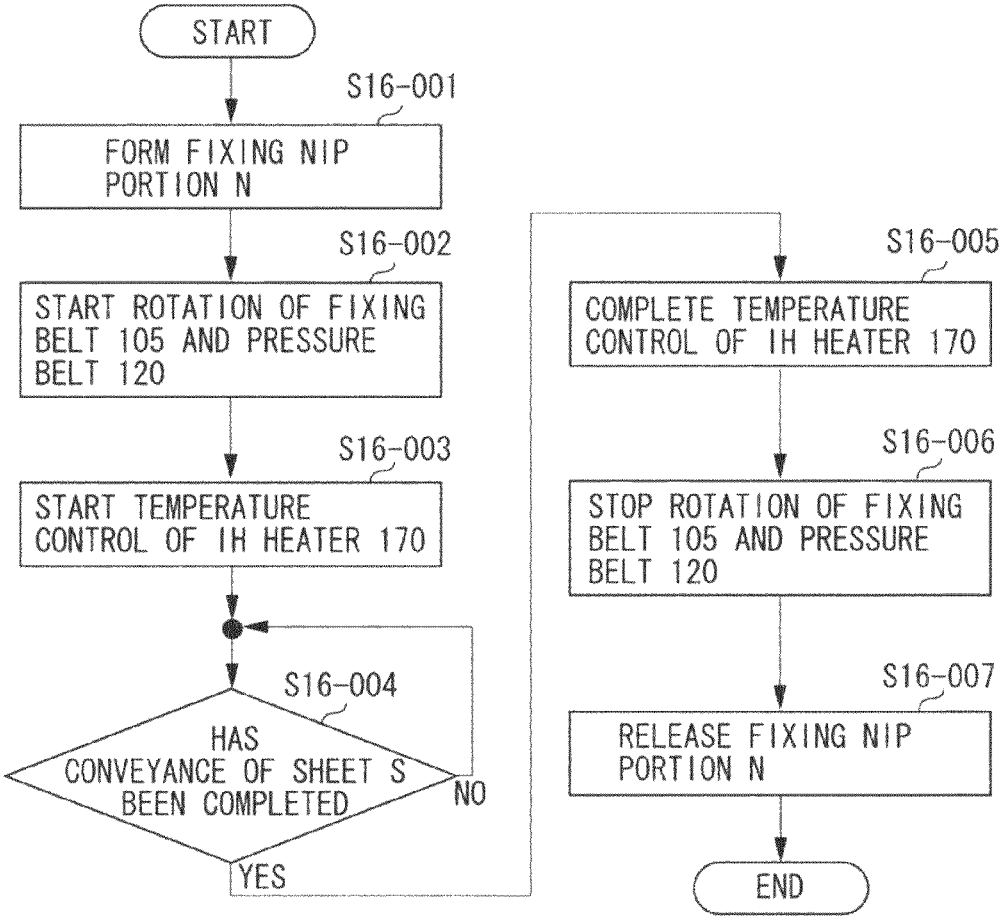
FIG. 9A is a flowchart illustrating fixing belt temperature control.
Figure 9B:
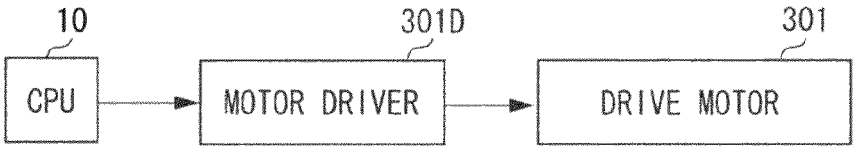
FIG. 9B is a block diagram illustrating the relevant control system.

Next, the fixing operation of the fixing apparatus 100 will be described with reference to the control flowchart of FIG. 9A and the control system block diagram of FIG. 9B. When the fixing apparatus 100 is on standby, the lower belt assembly B is retained at the separation position of FIG. 5. Drive of the drive motor 301 is stopped. The power supply to the IH heater 170 also stops.

The CPU 10 starts a predetermined image forming sequence control based on the input of a print job start signal. Regarding the fixing apparatus 100, the pressure motor 302 is driven with predetermined control timing via a motor driver 302D to drive the pressure cam shaft 307 to rotate thereof by half, thereby moving the lower belt assembly B from the separation position in FIG. 5 to the pressing position in FIG. 4. As a result, in step S16-001, the fixing nip portion N is formed between the fixing belt 105 and the pressure belt 120.

Next, the CPU 10 inputs drive to the drive input gear G by driving the drive motor 301 via the motor driver 301D. As a result, the drive roller 131 of the upper belt assembly A is driven as described above, and the rotation of the fixing belt 105 is started.

Further, the rotational force of the drive input gear G is also transmitted to the pressure roller 121 of the lower belt assembly B via a drive gear train (not illustrated), and the pressure roller 121 is driven to rotate counterclockwise as indicated by the arrow in FIG. 4. In step S16-002, with this rotation of the pressure roller 121, and due to the frictional force derived from the rotating fixing belt 105, the pressure belt 120 starts to rotate counterclockwise as indicated by the arrow. At the fixing nip portion N, moving direction of the fixing belt 105 and the pressure belt 120 are in the same direction at substantially the same moving speed.

Next, the CPU 10 supplies power to the heater via the heater controller 170C (FIG. 10B) and a heater driver 170D to thereby perform temperature control on the rotating fixing belt 105 by electromagnetic induction heating to raise its temperature to a predetermined target temperature. Specifically, in step S16-003, according to the grammage and kind of the sheet S passed, temperature control is started such that the temperature of the fixing belt 105 is raised to and maintained at the target temperature ranging from 140° C. to 200° C. (approximately 150° C. in the present exemplary embodiment).

In the state in which the formation of the fixing nip portion N, the rotation of the fixing belt 105 and the pressure belt 120, and the raising and adjustment of the temperature of the fixing belt 105 have been effected, the sheet S with an unfixed toner image t (FIG. 4) formed on the surface thereof is introduced into the fixing apparatus 100 from the image forming unit. The sheet S is guided by an inlet guide 184 arranged at the sheet inlet portion of the fixing apparatus 100, and enters the fixing nip portion N, which is the pressure contact portion between the fixing belt 105 and the pressure belt 120. A flag sensor 185 equipped with a photo interrupter is arranged at the inlet guide 184, and detects the timing with which the sheet S passes.

The image bearing surface of the sheet S is opposite to the fixing belt 105, and the surface thereof on the opposite side faces the pressure belt 120, and, in this state, the sheet S is conveyed while being pinched at the fixing nip portion N. Then, the unfixed toner image t is fixed as a stationary image to the sheet surface by the heat of the fixing belt 105 and the nip pressure. The sheet S having passed the fixing nip portion N is separated from the surface of the fixing belt 105, and is output from the sheet outlet side of the fixing apparatus 100 before being conveyed and discharged onto a discharge tray 21 by a discharge roller pair 20 (FIG. 2).

If the conveyance of the sheet S in a predetermined print job for a single sheet or a plurality of successive sheets has been completed (YES in step S16-004), in step S16-005, the CPU 10 completes the heating and temperature control of the fixing belt 105 and turns off the power supply to the IH heater 170. Further, in step S16-006, the CPU 100 turns off the drive motor 301 to stop the rotation of the fixing belt 105 and the pressure belt 120.

Further, the pressure motor 302 is driven via the motor driver 302D, and the pressure cam shaft 307 is driven to rotate by half, whereby the lower belt assembly B is moved from the pressing position of FIG. 4 to the separation position of FIG. 5. As a result, in step S16-007, the fixing belt 105, the pressure belt 120, and the fixing nip portion N are released. In this state, the CPU 10 waits for the input of the next print job start signal.

Figure 10A:
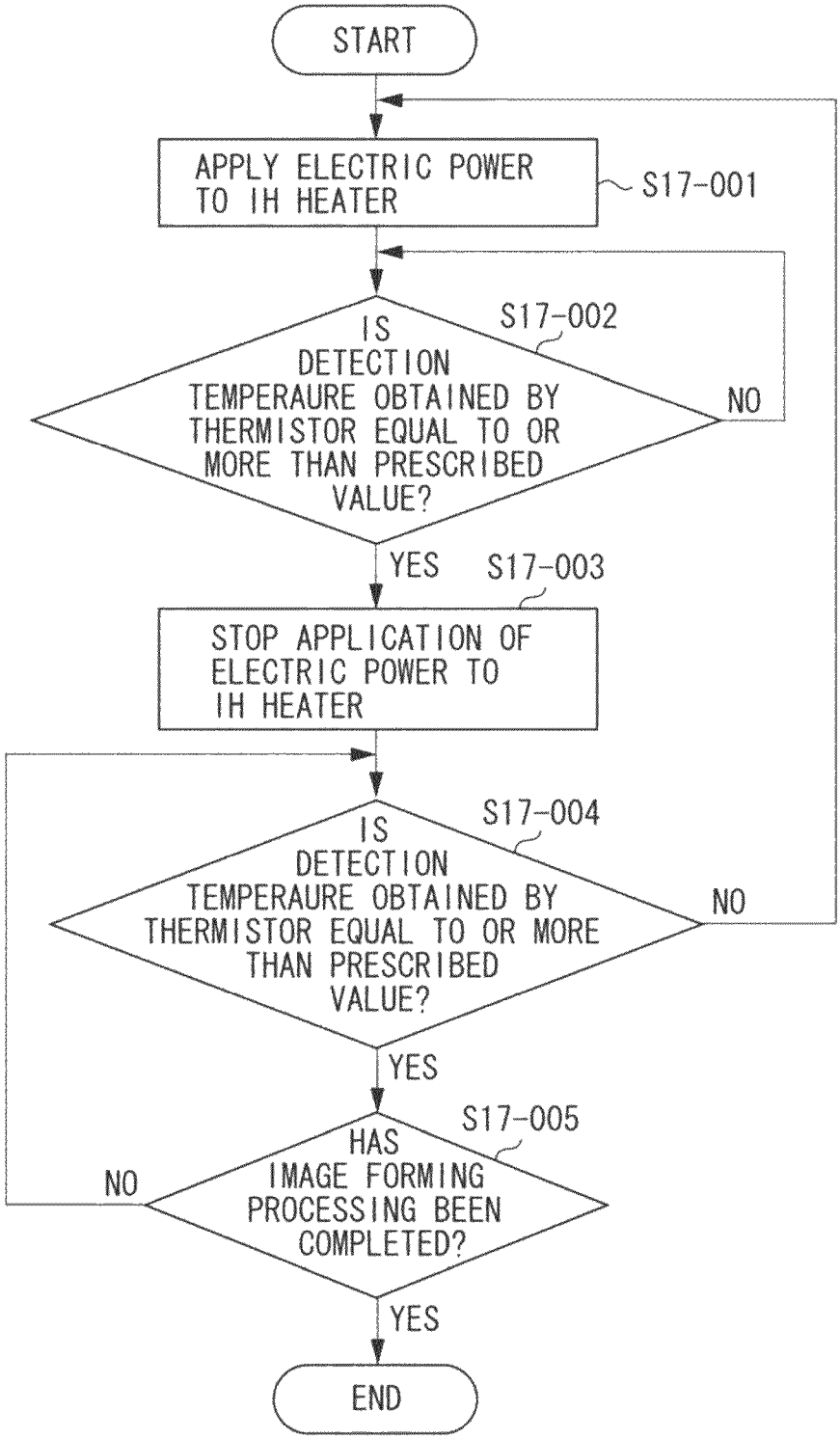
FIG. 10A is an explanatory view of a sensor unit for detecting a fixing belt end portion.
Figure 10B:
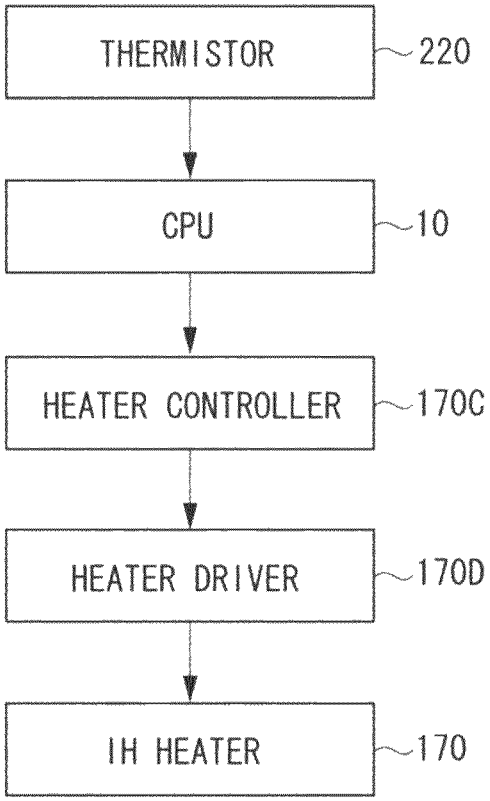
FIG. 10B is a diagram illustrating a combination of ON/OFF signals of first and second sensors and the positional relationship at the time of combination.

The temperature control of the fixing belt 105 will be described with reference to the control flowchart of FIG. 10A and the control system block diagram of FIG. 10B. A thermistor 220 as a temperature detection member for detecting the surface temperature of the fixing belt 105 is arranged in the upper belt assembly A. In step S17-001, the CPU 10 applies power to the IH heater 170 via the heater controller 170C and the heater driver 170D with predetermined control timing based on the input of a print job start signal. The temperature of the fixing belt 105 is increased by electromagnetic induction heating with the IH heater 170.

The temperature of the fixing belt 105 is detected by the thermistor 220, and detection temperature information (electrical information related to temperature) is input to the CPU 10. If the temperature detected by the thermistor 220 attains a level equal to or more than a predetermined value (target temperature) (YES), in step S17-003 the CPU 10 stops the supply of power to the IH heater 170. After this, If the temperature detected by the thermistor 220 becomes lower than the predetermined value (NO in step S17-004), the CPU 10 resumes the application of power to the IH heater 170 (step S17-001).

By repeating the above steps S17-001 through S17-004, the fixing belt 105 is maintained at the predetermined target temperature. Then, the above fixing belt temperature control is executed until the completion (step S17-005) of a predetermined print job for a single sheet or a plurality of sheets.

(2-4) Belt Deviation Control Mechanism (Displacing Mechanism)

Figure 11A:
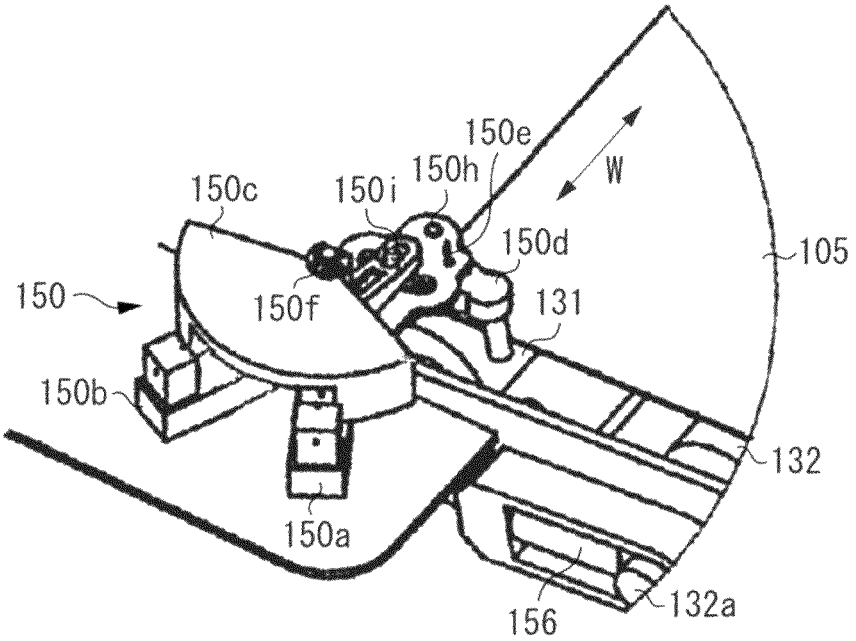
FIGS. 11A and 11B are explanatory view illustrating steering roller inclination control.

During its rotation process, the fixing belt 105 can undergo a phenomenon (belt deviation movement) in which it moves to be deviated to one or the other side in the width direction W (FIGS. 1, 11A, and 12) orthogonal to the sheet conveyance direction V. The pressure belt 120, which is brought into press contact with the fixing belt 105 to form the fixing nip portion N, also makes such deviation movement together with the fixing belt 105.

In the present exemplary embodiment, this deviation movement of the fixing belt 105 is restricted within a predetermined deviation range (predetermined zone) by swing deviation control. The swing deviation control is a method in which when it is detected that the belt position has moved from the central portion in the width direction by not less than a predetermined amount, the steering roller 132 is inclined in a direction opposite the deviation moving direction of the fixing belt 105.

By repeating this swing deviation control, the fixing belt 105 periodically moves from one side in the width direction (one direction in the width direction) to the other side (the other direction in the width direction), so that it is possible to control the belt deviation in a stable manner. In other words, the fixing belt 105 is formed so as to be capable of reciprocating in the direction W orthogonal to the conveyance direction V for the sheet S.

In the upper belt assembly A, at a position on the left-hand side (front side) of the fixing belt 105 and nearer to the steering roller 132, a sensor unit 150 (FIG. 11A) for detecting the fixing belt end portion position is provided. The CPU 10 detects the end portion position of the fixing belt 105 (belt deviation movement position) by this sensor unit 150, and, according to the detection, the CPU 10 performs the belt deviation control during belt rotation.

Figure 1:
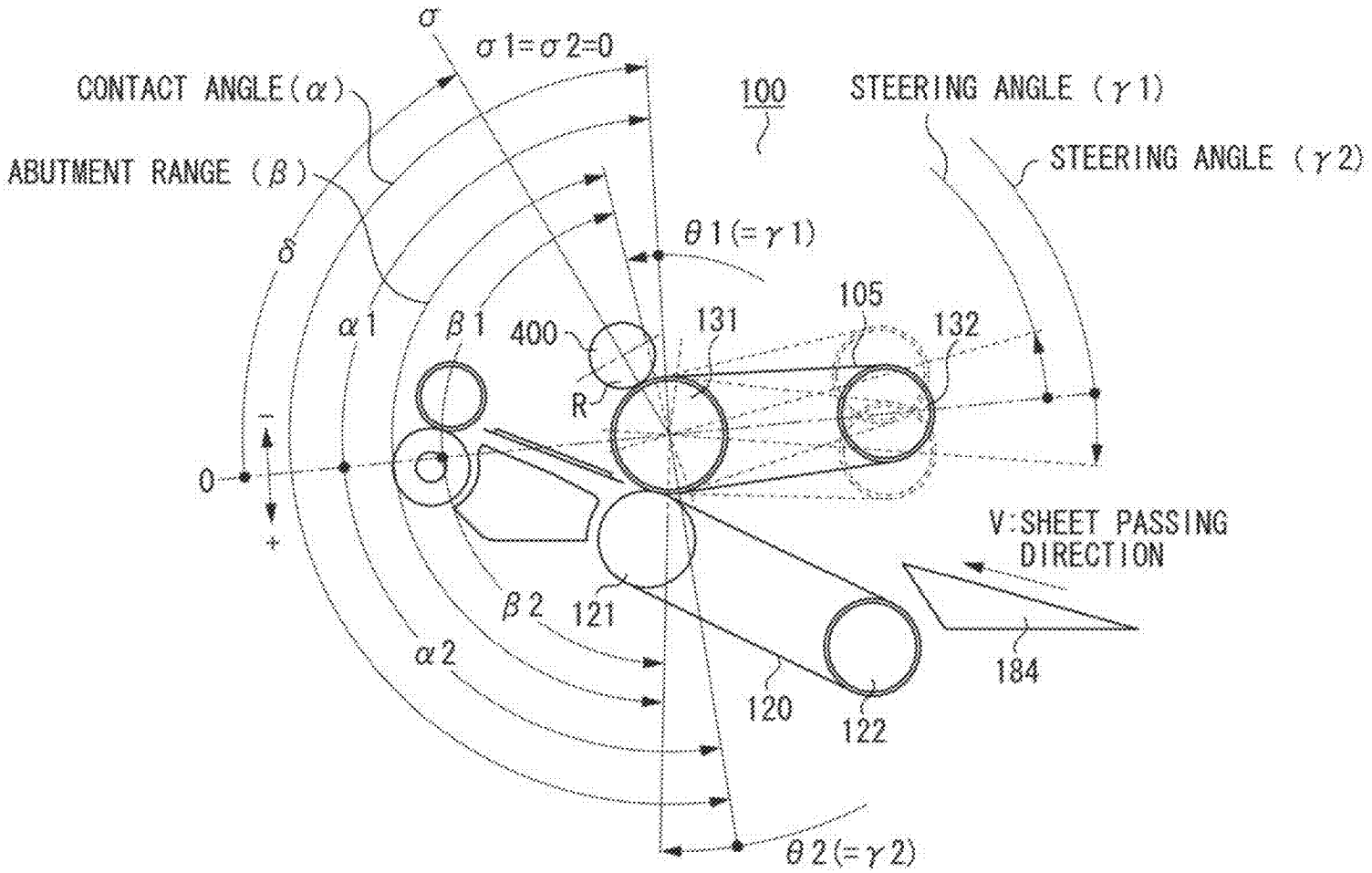
FIG. 1 is a schematic diagram illustrating the relationship between an inclined state of a fixing belt and an abutment position of a rubbing roller in a fixing device according to a first exemplary embodiment.
Figure 12:
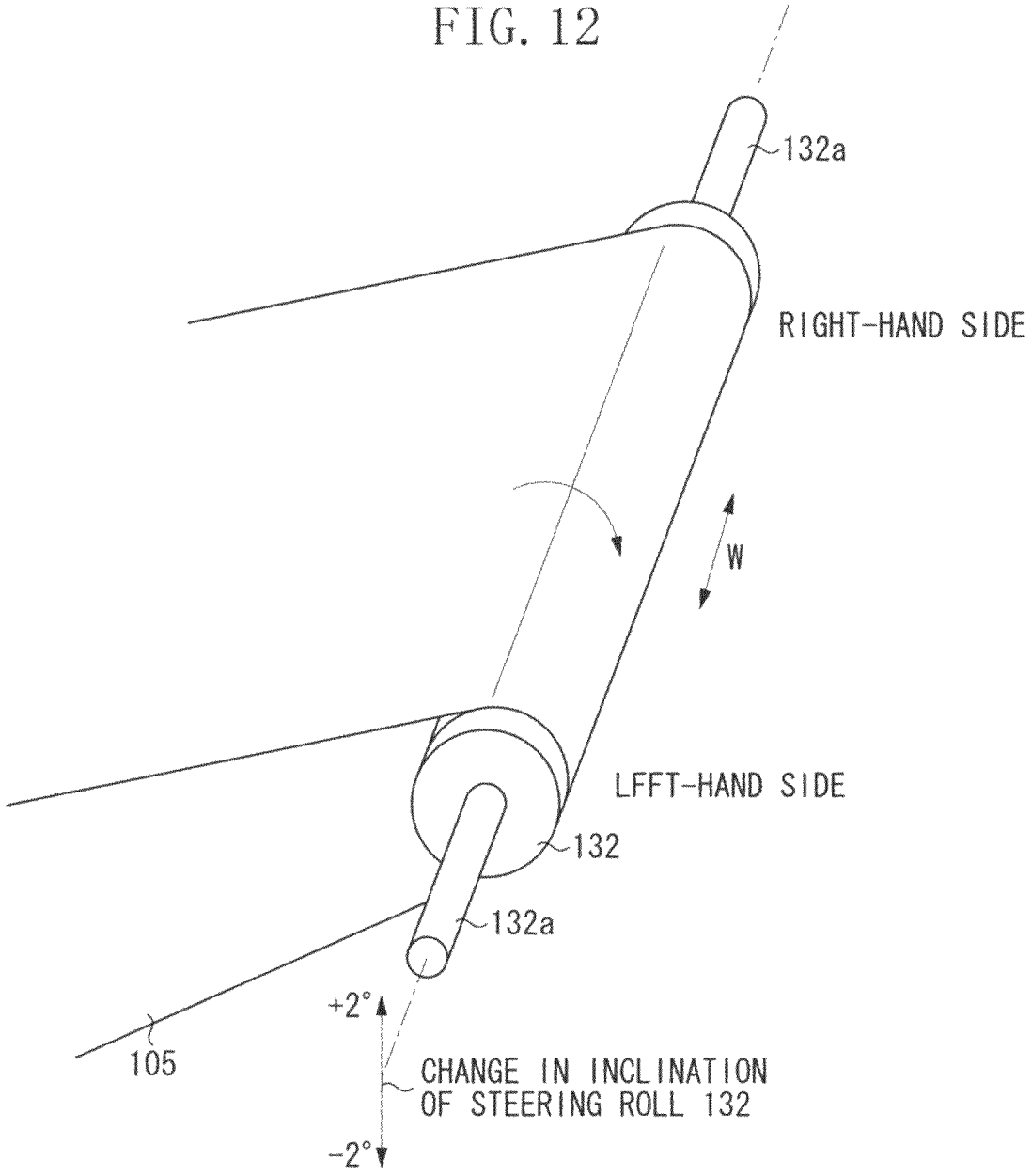
FIG. 12 is a graph illustrating belt end portion position and flag logic.

The CPU 10 detects the end portion position of the fixing belt 105 by this sensor unit 150, and, according to the detection, rotates the stepping motor 155 clockwise or counterclockwise by a predetermined number of rotations. As a result, the left-hand side steering roller supporting arm 154 rotates upwards or downwards around the shaft 131*a* by a predetermined control amount via the above-mentioned mechanisms 157, 152, 161, and 151 of FIGS. 6 and 7. In conjunction therewith, the steering roller 132 is displaced (changed in inclination) to perform deviation control on the fixing belt 105. In FIGS. 1 and 12, the displacing direction of the steering roller 132 is the vertical direction, so that when the traveling path of the fixing belt 105 is changed with the displacement of the steering roller 132, the fixing belt 105 can be separated from the supporting roller 131 (when the rubbing roller is separate from the fixing belt).

The sensor unit 150 includes first and second sensors 150*a* and 150*b*, and a sensor flag 150*c* rotatable clockwise or counterclockwise around a shaft 150*f*. By the clockwise or counterclockwise rotation of this sensor flag 150*c*, the first and second sensors 150*a* and 150*b* are respectively turned on and off in a predetermined relationship. Further, the sensor unit 150 has a sensor arm 150*d* rotatable clockwise or counterclockwise around a shaft 150*h*.

The sensor arm 150*d* is urged to rotate around the shaft 150*h* so as to abut on the right-hand side end surface of the fixing belt 105 by a sensor spring 150*e*. In the present exemplary embodiment, the sensor arm 150*d* is constantly brought into press contact with the right-hand side end surface of the fixing belt 105 with a force of 3 gf. Thus, the sensor arm 150*d* rotates clockwise or counterclockwise around the shaft 150*h* following the deviation movement of the fixing belt 105.

The sensor flag 150*c* and the sensor arm 150*d* are connected together by a connection mechanism 150*i* including a pin and an elongated hole. Thus, the sensor arm 150*d* rotates clockwise or counterclockwise following the deviation movement of the fixing belt 105, and the sensor flag 150*c* rotates clockwise or counterclockwise following this sensor arm 150*d*. As a result, the first and second sensors 150*a* and 150*b* are turned on and off in a predetermined relationship. The CPU 10 performs the deviation position detection of the fixing belt 105 by a combination of the respective ON/OFF signals of the first and second sensors 150*a* and 150*b*.

Figure 11B:
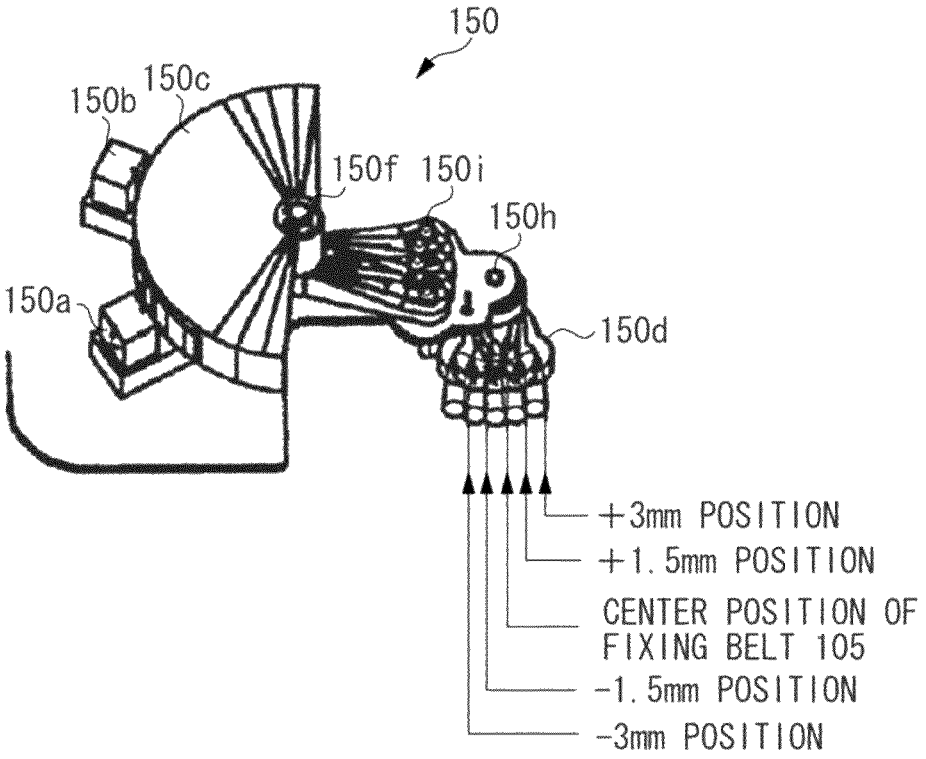
Figures 14A, 14B:
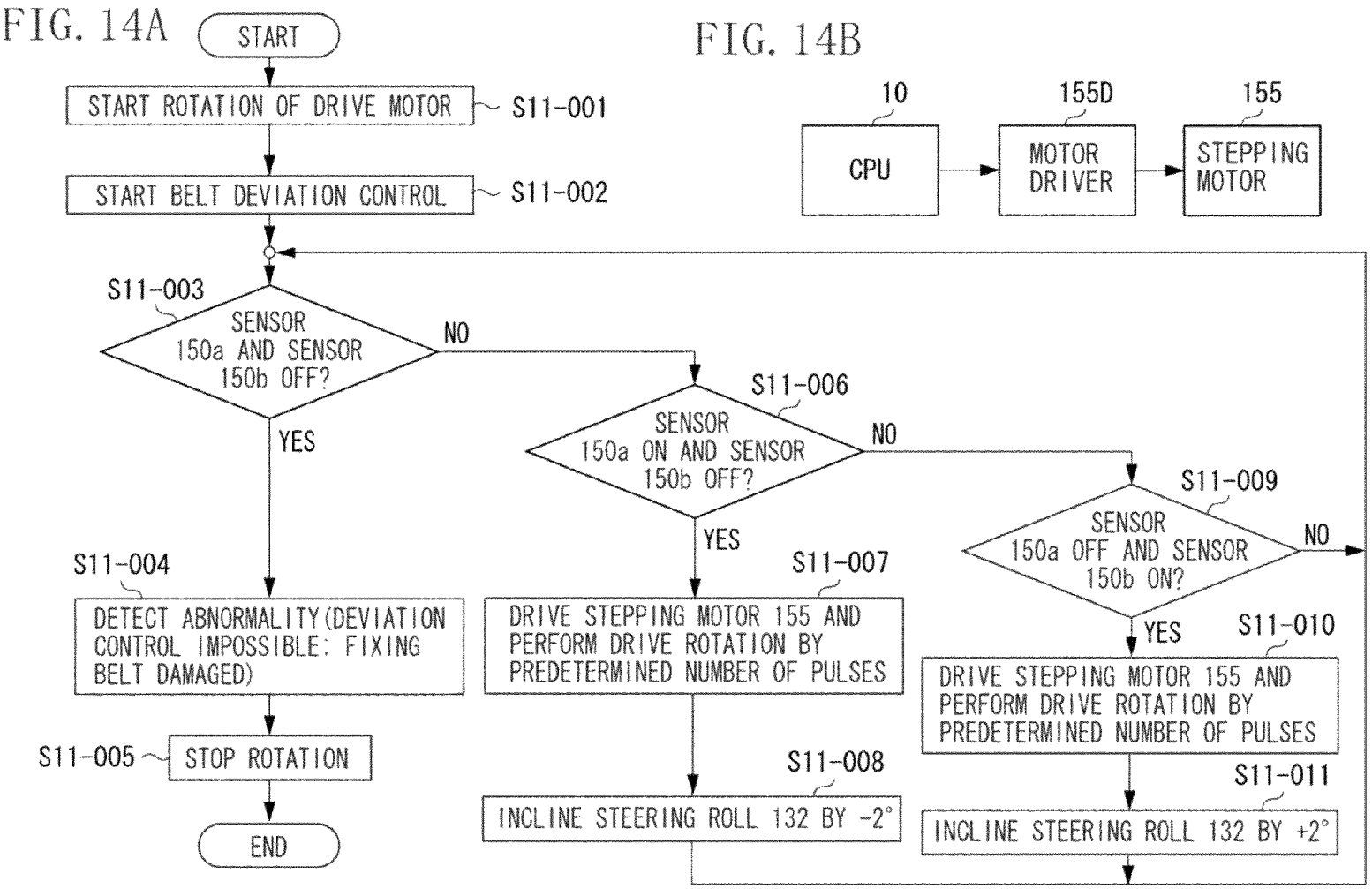
FIGS. 14A and 14B are explanatory views illustrating a roughening mechanism (surface property recovery mechanism).

FIG. 11B illustrates a combination of the ON/OFF signals of the first and second sensors 150*a* and 150*b* and the positional relationship at that time, and FIG. 13 illustrates the relationship of the end surface position of the fixing belt 105 at that time. Further, FIG. 14 illustrates a deviation control flowchart. The signal is OFF when the sensors 150*a* and 150*b* are shielded by the sensor flag 150*c*, and the signal is ON when light is emitted. The right-hand side of the fixing belt 105 is the front side, and the left-hand side thereof is the rear side.

As described above, the CPU 10 brings the lower belt unit B into press contact with the upper belt unit A with predetermined control timing based on the input of the print job start signal to form the fixing nip portion N. Then, in step S11-001, the rotation of the drive motor 301 is started. As a result, the fixing belt 105 and the pressure belt 120 rotate. In step S11-002, the CPU 10 starts the belt deviation control from the start of this rotation of the drive motor 301.

The fixing belt 105 reciprocates between a position where the first sensor 150*a* is ON and the second sensor 150*b* is OFF (step S11-006) and a position where the first sensor 150*a* is OFF and the second sensor 150*b* is ON (step S11-009). The swing deviation control is performed such that the fixing belt 105 exists within this section. The pressure belt 120 makes deviation movement together with this deviation control of the fixing belt 105.

The distance of this section is ±1.5 mm as measured from the center position in the rotation axis direction of the fixing belt 105. In steps S11-007 and S11-010, the CPU 10 outputs a predetermined drive pulse to the stepping motor 159 from the position of the fixing belt 105 as measured by the sensor unit 150 via the motor driver 155. In steps S11-008 and S11-011, the steering roller 132 performs control by being driven by the stepping motor 159 and inclining by ±2° with respect to the drive roller 131.

In step S11-003, in the state in which the deviation control is impossible, when the end surface of the fixing belt 105 comes to a position ±3 mm from the center position, both the first and second sensor 150*a* and 150*b* are turned off. At this time, in step S11-004, the CPU 10 determines that abnormality has been generated, and causes emergency stop of the printing operation (image forming operation) of the printer 1. Regarding the fixing apparatus 100, in step S11-005, the power supply to the IH heater 170 is turned off to stop the heating of the fixing belt 105 and, at the same time, the drive motor 301 is turned off to stop the rotation of the fixing belt 105 and the pressure belt 120.

Further, the CPU 10 displays, on the display portion of the printer operation unit 24 (FIG. 2), the generation of abnormality in the fixing apparatus 100 to urge the user to notify the serviceman. In a case of remote monitoring system, the CPU 10 notifies the service company of the generation of abnormality.

(2-5) Roughening Mechanism for the Fixing Belt 105

Next, a roughening mechanism (surface property recovery mechanism) for conducting surface property recovery for the fixing belt 105 (adjustment of the surface state of the belt 105) will be described with reference to FIGS. 15A and 15B. In the present exemplary embodiment, above the drive roller 131 of the upper belt unit 131, a rubbing roller 400 as a rubbing member (rotatable roughening member) configured to recover the surface property of the fixing belt 105 by abutting on and rubbing the fixing belt 105 is arranged. The rubbing roller 400 is rotatably supported between a pair of right and left RF supporting arms 141 via bearings (not illustrated), with the RF supporting arms 141 being rotatably supported by fixation shafts 142 respectively coaxially fixed to the right and left upper side-plates 140 of the apparatus casing.

For the rubbing roller 400, the surface of a stainless steel core of ϕ12 mm is bonded with dense abrasive grains via a bonding layer. The abrasive grains may be changed to #1000 to #4000 according to the use (the target gloss of the image). In a case of #1000 abrasive grains, the average particle diameter of the abrasive grains is approximately 16 μm, and, in a case of #4000 abrasive grains, it is approximately 3 μm. The abrasive grains are of the alumina type (usually also referred to as "alundum" or "molundum"). The alumina type abrasive grains are abrasive grains most widely used in industry. They are of much higher hardness as compared with the surface of the fixing belt 105, and are superior in abrasive property owing to the sharp angle configuration of the grains.

In the present exemplary embodiment, there is installed a moving mechanism configured to move the rubbing roller between a abutment position (rubbing position) at which the rubbing roller abuts on the fixing belt 105 and a separation position at which the rubbing roller is spaced away from the fixing belt 105. Specifically, above the right and left RF supporting arms 141, RF cams (eccentric cams) 407 are respectively arranged. The right and left RF cams 407 are fixed in the same configuration and the same phase to an RF cam shaft 408 rotatably borne and supported between the right and left upper side-plates 140 of the apparatus casing. RF separation springs 405 are fixed to between the arm end portions on the side opposite the side of which the right and left supporting arms 141 support the rubbing roller 400 and RF separation shafts 406 which are fixed to the right and left upper side-plates 140, and are stretched therebetween.

Owing to the tension of the RF separation springs 405, respective right and left RF supporting arms 141 are normally rotationally urged so as to lift the rubbing roller 400 around stationary shafts 142, with the upper surfaces of the arms being elastically pressed against the lower surfaces of corresponding right and left RF cams 407. As illustrated in FIG. 15B, an RF attachment/detachment gear 409 is fixed to the right side end portion of the RF cam shaft 408. An RF motor gear 411 of an RF pressure motor 410 is in mesh with this RF attachment/detachment gear 409.

In the present exemplary embodiment, the right and left RF cams 407 are normally at rest in a first orientation of a rotation angle in which the large bulge portions face upwards similar to FIGS. 4 and 5. In this state, the right and left RF supporting arms 141 respectively correspond to the small bulge portions of the corresponding RF cams 407. Thus, the rubbing roller 400 is retained at the separation position at which the rubbing roller 400 is spaced away from the fixing belt 105 by a predetermined distance. Specifically, the rubbing roller 400 is lifted above the fixing belt 105, and does not act on the fixing belt 105.

Figure 15A:
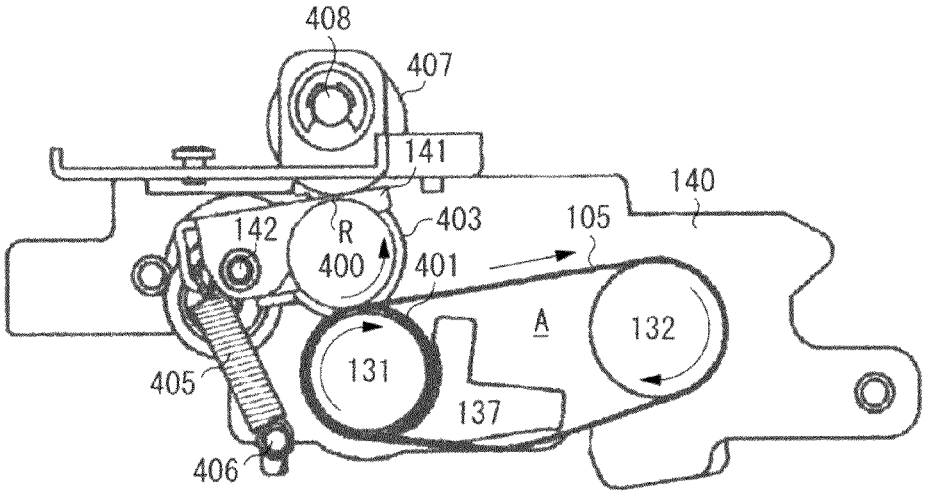
FIG. 15A is a flowchart illustrating roughening mechanism control.
Figure 15B:
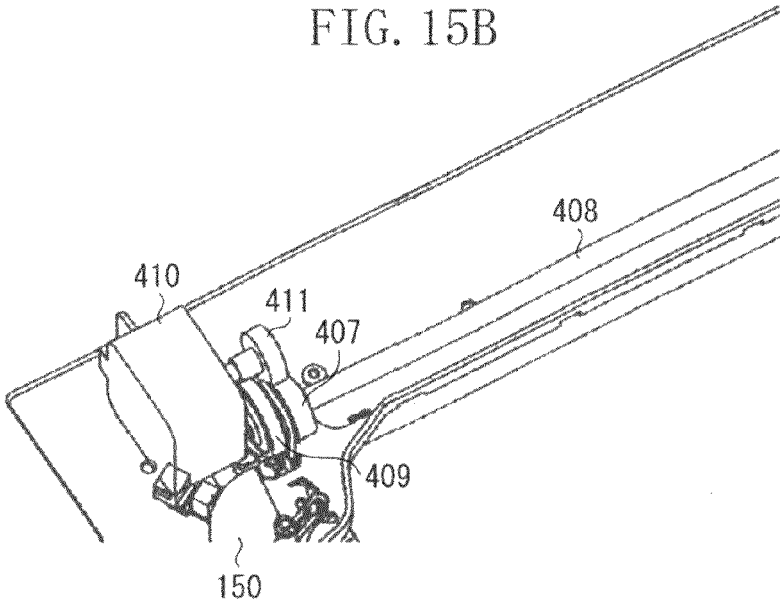
FIG. 15B is a block diagram illustrating a control system.

The right and left RF cams 407 are rotated by 180 degrees from the above first attitude to be converted to and retained in a second orientation of a rotation angle at which the large bulge portions are directed as illustrated in FIG. 15A. In this state, the right and left RF supporting arms 141 are pushed down around the stationary shafts 142 against the RF separation springs 405 by the respectively corresponding RF cams 407.

And, the rubbing roller 400 is converted to and retained at the pressing position where the rubbing roller 400 is brought into contact with the surface of the fixing belt 105 at the belt wrapping portion of the drive roller 131 with a predetermined pressing force to form a roughening nip R. Specifically, the rubbing roller 400 is urged toward the rotation center of the drive roller 131 via the fixing belt 105. The above configuration provides a roughening member supporting unit (mechanism) in which the RF supporting arms 141 and the RF cams 407 swingably support the rubbing roller 400 and urge thereof toward the drive roller 131 via the fixing belt 104.

Further, an RF gear 403 fixed to the end portion of the rubbing roller 400 is held in mesh with an RF drive gear 401 fixed to the end portion of the drive roller 131. As a result, the rotational force of the drive roller 131 is transmitted to the rubbing roller 400 via the RF drive gear 401 and the RF gear 403, and the rubbing roller 400 rotates in the opposite direction of the rotating direction of the fixing belt 105. Specifically, the rubbing roller 400 having an abrasive layer on its surface rotates in a WITH direction (the direction in which the surfaces move in the same direction in a contact position where the rubbing roller and the fixing belt are in contact with each other) with respect to the fixing belt 105 with a circumferential speed difference, and has the function of uniformly roughening the surface of the fixing belt 105 (the function of making the surface even: the function of adjusting the surface condition).

In other words, the rubbing roller 400, which is a rubbing rotary member, is a roller member configured to rotate with a circumferential speed difference with respect to the fixing belt 105. The positional conversion of the rubbing roller 400 between the separation position and the pressing position is effected by the right and left RF cams 407 being subjected to orientation conversion between the first orientation and the second orientation as described above by the RF pressure motor 410 via the RF motor gear 411, the RF attachment/detachment gear 409, and the RF cam shaft 408. In FIG. 15A, the lower belt unit B, which is pressed by the upper belt unit A to form the fixing nip portion N, is omitted.

Figure 16A:
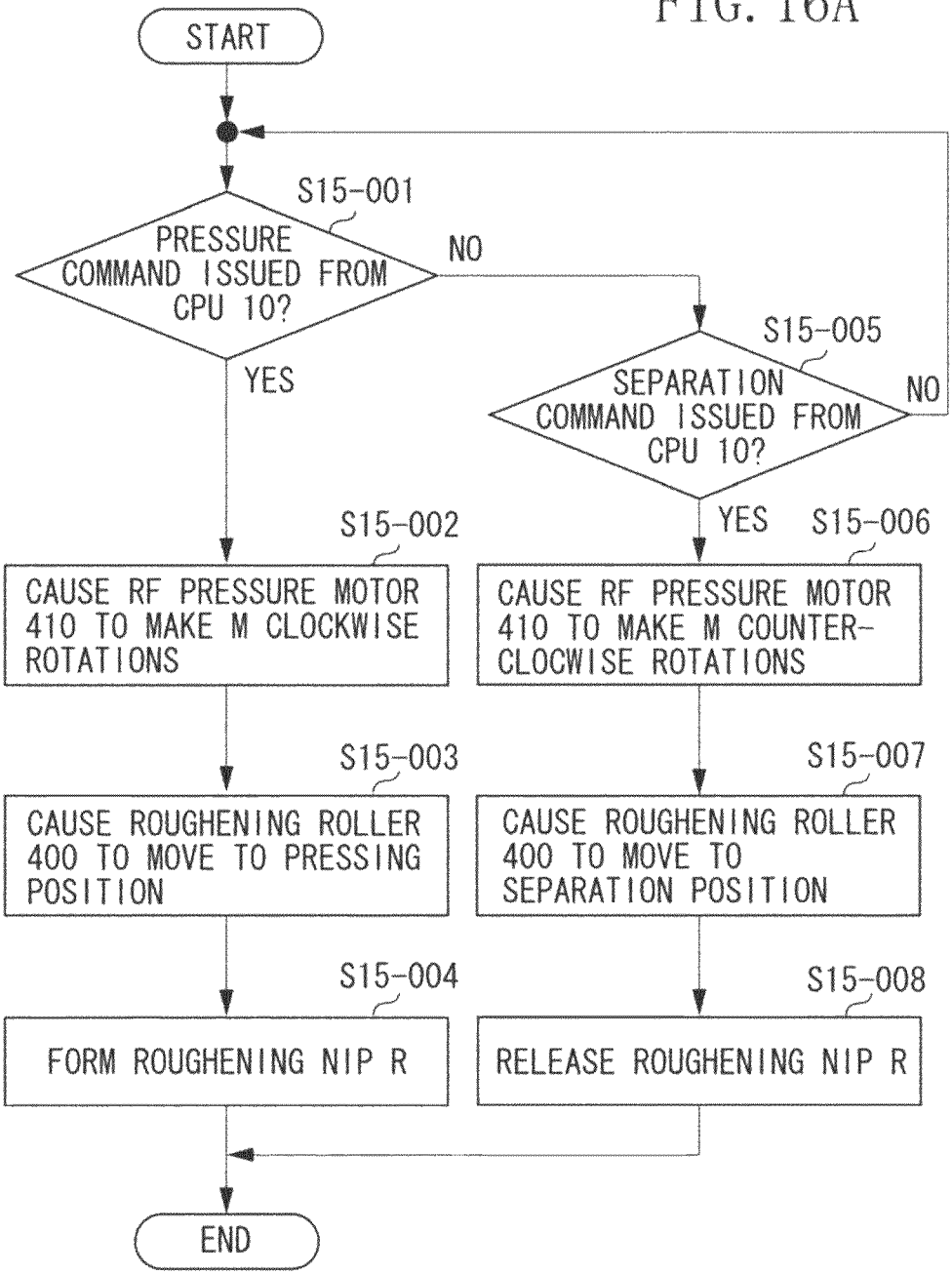
FIGS. 16A and 16B are flowcharts illustrating a surface property recovery operation.
Figure 16B:
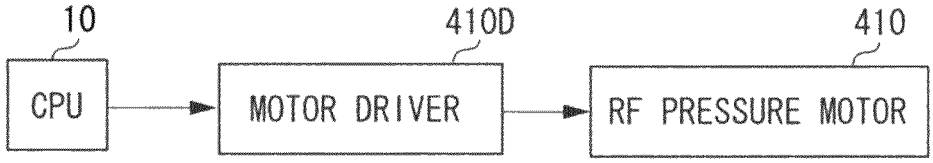

FIG. 16A is an operational flowchart for the above roughening mechanism. As described above, the right and left RF cams 407 of the roughening mechanism are normally at rest in the first orientation of rotation angle in which the large bulge portions face upwards as illustrated in FIGS. 4 and 5. In other words, the rubbing roller 400 is retained at the separation position, at which the rubbing roller 400 is spaced away from the fixing belt 105 by a predetermined distance.

The CPU 10 issues a pressure command to cause with predetermined pressure control timing (YES in step S15-001), and in step S15-002, the CPU 10 causes the RF pressure motor 410 to be driven clockwise by the motor driver 410D to make M rotations, which is a predetermined number of rotations. As a result, in S15-003, the right and left RF cams 407 are converted from the first orientation (FIGS. 4 and 5) to the second orientation (FIG. 15A), and the rubbing roller 400 is moved from the separation position to the pressing position. The rubbing roller 400 moves to the pressing position, whereby in step S15-004, the fixing belt 105 and the rubbing roller 400 are brought into press contact with each other to form the roughening nip R.

In step S15-005, the CPU 10 issues a separation command to cause with predetermined separation control timing, and in step S15-006, the CPU 10 causes the RF pressure motor 410 to make M counterclockwise rotations, which is a predetermined number of rotations, by the motor driver 410D. As a result, in step S15-007, the right and left RF cams 407 are restored from the second orientation (FIG. 15A) to the first orientation (FIGS. 4 and 5), and the rubbing roller 400 is moved from the pressing position to the separation position. The rubbing roller 400 moves to the separation position, whereby in step S15-008, the fixing belt 105 and the rubbing roller 400 are brought into press contact with each other to release the roughening nip R.

Next, the timing with which the surface property recovery operation for the fixing belt 105 is started by the rubbing roller 400, will be described. In the present exemplary embodiment, in the execution of a print job, the CPU 10 counts the number of supplied sheets S supplied to the fixing apparatus 100 by a number of supplied sheet counter and stores the integration value thus obtained.

If a predetermined number of supplied sheets (integration threshold value) N has been counted, the surface property recovery operation for the fixing belt 105 by the rubbing roller 400 is executed after the completion of the print job being executed or after interruption of the print job. Further, the s number of supplied sheets counter is reset to zero. In a case where the print job is interrupted, the remaining print job is resumed after the execution of the surface property recovery operation for the fixing belt 105.

Figure 17:
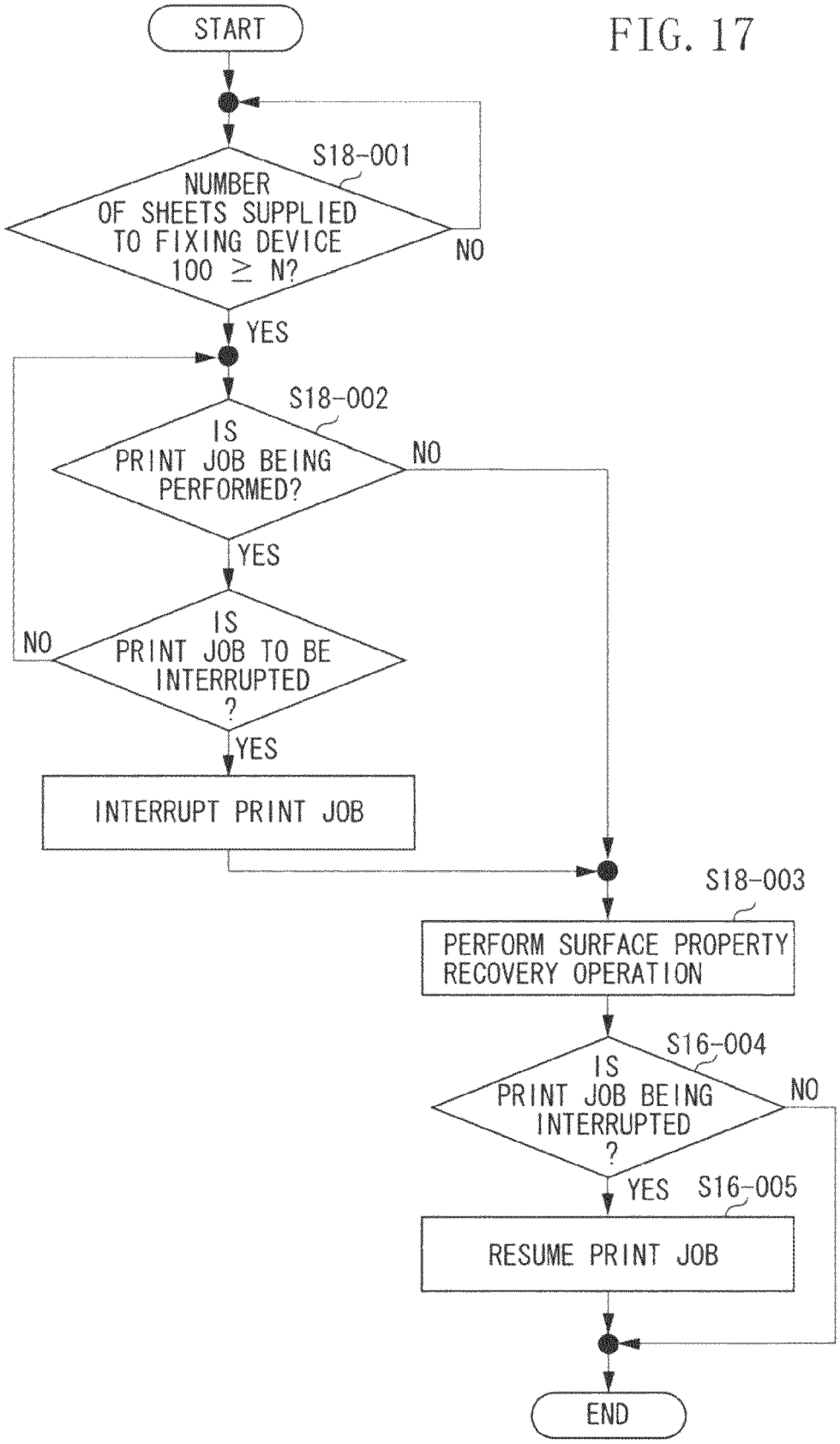
FIG. 17 is a flowchart illustrating the surface property recovery operation.

FIG. 17 is a flowchart illustrating the above surface property recovery operation. If the integration value of the number of supplied sheets has become equal to or more than N (YES in step S18-001), in step S18-003, the CPU 10 starts the surface property recovery operation after completing the print job (NO in step S18-002) or after temporarily interrupting the print job (YES in step S18-002). Further, the number of supplied sheet counter is reset to zero. If the surface property recovery operation is completed, the next print job is waited for (YES in step S18-004), or the next print job is waited for after the print job interrupted is resumed and completed in step S18-005.

In the present exemplary embodiment described above the surface property recovery operation for the fixing belt 105 by the rubbing roller 400 is started after a predetermined number of sheets have been supplied to the fixing apparatus 100. This, however, should not be construed. It is also possible to count solely the number of specific supplied sheets, or to execute the surface property recovery operation at a time prior to the print job for sheets of a specific type, or through operation by the user from the printer operation unit 24 (FIG. 2) in the state in which printing is waited for.

Figure 18:
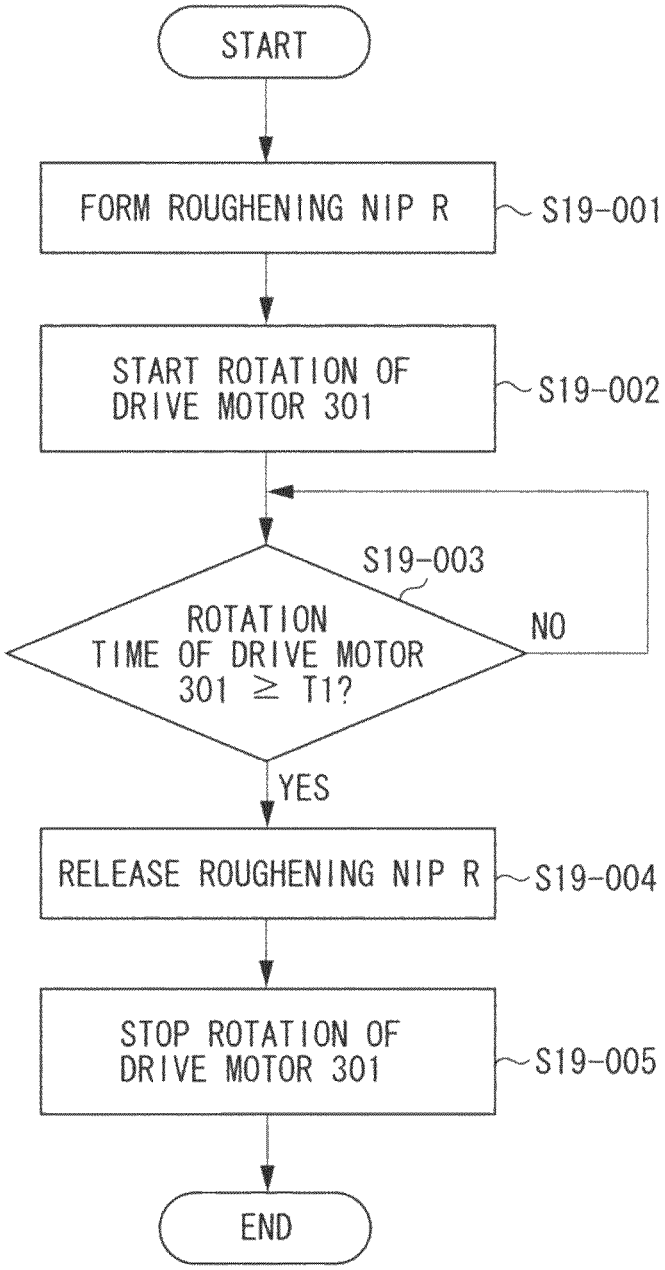
FIG. 18 is a graph for illustrating the problem to be solved by the present disclosure.

Next, the surface property recovery operation for the fixing belt 105 will be described in detail with reference to FIG. 18. In S19-001, the CPU 10 moves the rubbing roller 400 to the pressing position to form the roughening nip R with respect to the fixing belt 105.

Next, in step S19-002, the drive motor 301 is turned on, and is rotated for a predetermined time T1. Specifically, the fixing belt 105 is rotated for a predetermined period of time T1. At this time, the surface roughened to a surface roughness (Rz) of approximately 2.0, due to fixing operations for a plurality of sheets of a grammage of approximately 220 gsm, is recovered to approximately Rz 0.5 to 1.0.

After the predetermined period of time T1 has elapsed (YES in step S19-003), in step S19-004, the CPU 10 moves the rubbing roller 400 to the separation position to release the roughening nip R with respect to the fixing belt 105. Finally, in step S19-005, the rotation of the drive motor 301 is stopped, and the surface property recovery operation for the fixing belt is completed.

(2-6) Relationship between Inclination State of the Fixing Belt 105 and the Abutment Position of the Rubbing Roller 400

Next, the relationship between the inclination state of the fixing belt 105 and the abutment position of the rubbing roller 400 will be described. FIG. 1 is a schematic diagram illustrating the relationship between the inclination state of the fixing belt 105 and the abutment position of the rubbing roller 400 in the fixing apparatus 100 according to the present exemplary embodiment, and FIG. 19 is a diagram illustrating an example of a contact angle of the fixing belt 105 and of the abutment position of the rubbing roller.

Figure 19:
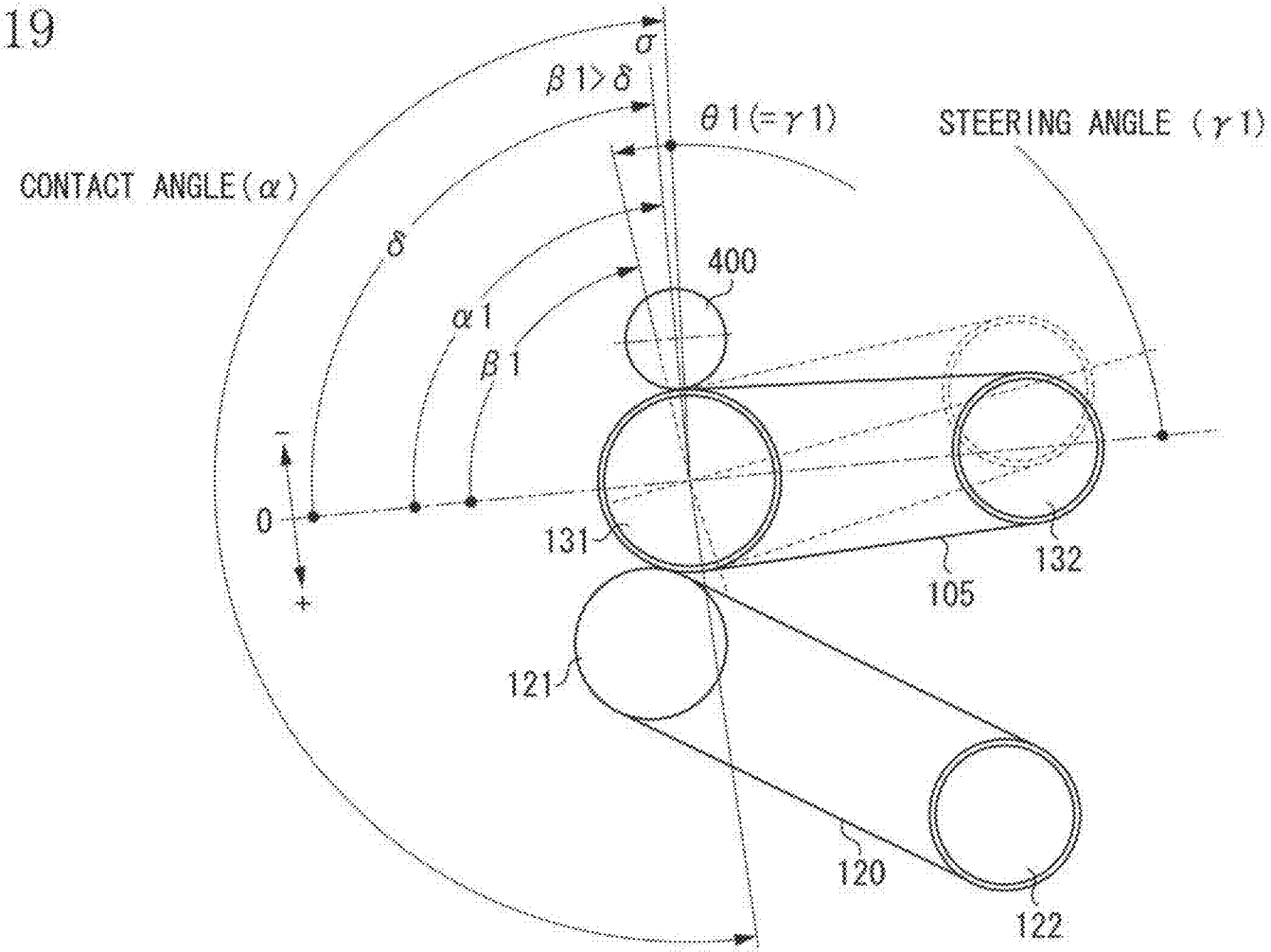
FIG. 19 is a schematic diagram illustrating the relationship between the inclined state of the fixing belt and the abutment position of the rubbing roller in the fixing device according to the first exemplary embodiment.

To avoid complicated illustration, in FIGS. 1 and 19, the pad stay 137 of the upper belt unit A, the pressure pad 125 of the lower belt unit B, etc. are omitted. This also applies to FIGS. 21A, 21B, 22A, 22B, and 23 in the second through fourth exemplary embodiments described below.

In the present exemplary embodiment, a position where rubbing is performed on the fixing belt by the rubbing roller is set to a position avoiding a region where the fixing belt 105 is separated (lifted) from the supporting roller 131 with the displacement of the steering roller 132 (at maximum displacement (at ±2° in FIG. 12)). In other words, the position where rubbing is performed on the fixing belt is set to a position in a region in which the fixing belt 105 remains supported by the supporting roller 131 despite the steering roller 132 performs displacing movement (at maximum displacement (at ±2° in FIG. 12)).

Owing to this configuration, there is no great variation in the longitudinal direction in the abutment pressure of the rubbing roller with respect to the fixing belt 105, and it is possible to execute the rubbing processing by the rubbing roller on the fixing belt without involving any unevenness in the width direction. Thus, it is possible to suppress generation of uneven gloss in the fixed image.

As described above, the lower belt unit B is brought into contact with the upper belt unit A, and the fixing nip portion is formed between the fixing belt 105 and the pressure belt 120. Further, deviation control is performed on the fixing belt 105 by a change in the inclination of the steering roller 132 by the belt deviation control mechanism. Further, the rubbing roller 400 rotates while being pressed against the drive roller 131 side with a predetermined pressure via the fixing belt 105 by the roughening mechanism, whereby the surface property recovery operation for the fixing belt 105 is executed.

In the belt deviation control, the position where the longitudinal axis of the steering roller 132 is substantially horizontal with respect to the longitudinal axis of the drive roller 131 is regarded as the neutral position. Using the rear side (right-hand side) as a reference, the front side (left-hand side) of the steering roller 132 can be inclined vertically by a predetermined steering angle (predetermined angle $\gamma 1$ and predetermined angle $\gamma 2$), for example, ±2°. Owing to this inclination, it is possible to move the fixing belt 105 to the front and rear sides (right and left sides), with its axis being deviated with respect to the drive roller 131.

The contact angle $\alpha$ of the fixing belt 105 wrapped around the drive roller 131 at the time of belt deviation control is constant independently of the angle of the steering roller 132. However, if the inclination of the steering roller 132 is changed by belt deviation control, the relative position between the fixing belt 105 wrapped around the drive roller 131 and the rubbing roller 400 changes according to the steering angle.

To illustrate the positional relationship, the symbols will be first described with reference to FIG. 1. The axis connecting the rotation center of the rubbing roller 400 and the rotation center of the drive roller 131 is indicated by symbol $\sigma$, and the abutment nip between the rubbing roller 400 and the fixing belt 105 formed in the axis $\sigma$ will be referred to as the roughening nip R.

At the above-mentioned neutral position, the contact angle of the fixing belt 105 wrapped around the drive roller 131 is indicated by symbol $\alpha$, and the abutment range of the rubbing roller 131 is indicated by symbol $\beta$. Of the axis connecting the rotation centers of the drive roller 131 and the steering roller 132, a coordinate system prepared on a side of a roller on which the rubbing roller 400 abuts will be referred to as the reference 0.

Further, the angles to the boundary points of the contact angle $\alpha$ as measured from the reference 0 will be referred to as the angles $\alpha 1$ and $\alpha 2$, the angles to the boundary points of the contact range $\beta$ of the rubbing roller 400 as measured from the reference 0 will be referred to as the angles $\beta 1$ and $\beta 2$, and the angle as measured from the reference 0 to the axis $\sigma$ of the rubbing roller 400 will be referred to as the angle $\delta$.

Further, if the steering roller 132 is inclined by a predetermined angle $\gamma 1$ in order to perform deviation control on the fixing belt 105 either in the front side direction or in the rear side direction, the movement angle in the nip R direction of the boundary point of the fixing belt 105 will be referred to as an angle $\theta 1$, and the rotation angle of the axis $\sigma$ will be referred to as an angle $\sigma 1$.

Further, if the steering roller 132 is inclined by a predetermined angle $\gamma 2$ in order to perform deviation control on the fixing belt 105 in the direction opposite the above-mentioned direction, the movement angle in the nip R direction of the boundary point of the fixing belt 105 will be referred to as an angle $\theta 2$, and the rotation angle of the axis $\sigma$ will be referred to as an angle $\sigma 2$.

In the above angular coordinate system, counterclockwise movement from the above-mentioned reference 0 is indicated by symbol +, and clockwise movement from the same is indicated by symbol –. First, referring to FIGS. 1 and 19, the position where the rubbing roller 400 is brought into contact with the drive roller 131 rotatably supported with respect to the right and left upper side-plates 140 of the apparatus casing will be described.

The feature of this configuration lies in the fact that the rubbing roller 400 constantly abuts on the drive roller 131 to form the roughening nip R. If the steering roller 132 is inclined by the predetermined angle $\gamma 1$ or the predetermined angle $\gamma 2$, the rubbing roller 400 does not move but the fixing belt 105 is inclined, with solely the relative position of the contact angle $\alpha$ of the rubbing roller 400 with respect to the roughening nip R being changed.

If the steering roller 132 is inclined by the predetermined angle $\gamma 1$, the position of the contact angle $\alpha$ moves to the roughening nip R side by the predetermined angle $\gamma 1$, whereby the boundary point of the contact angle of the fixing belt 105 moves by the angle $\theta 1$ ($=\gamma 1$) to the + side. At this time, the axis $\sigma$ of the rubbing roller 400 does not move, so that $\sigma 1=0$. Accordingly, $\beta 1$ can be expressed as follows: $\beta 1=\alpha 1+\theta 1$.

Similarly, if the steering roller 132 is inclined by the predetermined angle $\gamma 2$, the position of the contact angle $\alpha$ moves to the nip R side by the angle $\gamma 2$, whereby the boundary point of the contact angle of the fixing belt 105 moves by the angle $\theta 2$ ($=\gamma 2$) to the – side. At this time also, the axis $\sigma$ of the rubbing roller 400 does not move, so that $\sigma 2=0$. Accordingly, $\beta 2$ can be expressed as follows: $\beta 2=\alpha 2+\theta 2$ In other words, it is only necessary for the axis G of the rubbing roller 400 to exist in the range of $\beta 1$ and $\beta 2$ where $\beta 1=\alpha 1+\theta 1$, and $\beta 2=\alpha 2+\theta 2$, and it is necessary that the following relationship should holds true: $\beta 1 \leq \delta \leq \beta 2$. This makes it possible to form the nip R of the rubbing roller 400 at a position free from the influence of the inclination of the steering roller 132, allowing the roughening state on the inclination side and the non-inclination side of the fixing belt 105 to be uniform.

Here, to confirm the above formula, a case will be considered where the nip R of the rubbing roller 400 is formed at a position where the fixing belt 105 is lifted from the drive roller 131. An example thereof will be described with reference to FIG. 19. At the neutral position, the rubbing roller 400 abuts on the fixing belt 105 wrapped around the drive roller 131 to form the nip R. However, if the steering roller 132 is inclined by the angle $\gamma 1$, if the fixing belt 105 moved by the angle $\theta 1$, the boundary point of the contact angle would exceed the nip R. At this time, $\beta 1=\alpha 1+\theta 1 \geq \delta$, which means the above-mentioned formula is not satisfied.

As a result, the fixing belt 105 forms the nip R at a position where the fixing belt 105 is lifted from the drive roller 131, and the abutment area of the fixing belt 105 with respect to the rubbing roller 400 increases. Further, the reaction force due to the tension of the fixing belt 105 causes the predetermined pressure not to be applied. As a result, the roughening state on the inclination side and the non-inclination side of the fixing belt 105 becomes uneven, causing the recording material not to attain uniform gloss. This also applies to $\beta 2$.

From the above, in the configuration of FIG. 1, with respect to $\beta 1$ and $\beta 2$ satisfying the relationship $\beta 1=\alpha 1+\theta 1$, and $\beta 2=\alpha 2+\theta 2$, it is necessary for the angle $\delta$ of the axis $\sigma$ of the rubbing roller 400 to be arranged in a range satisfying the relationship: $\beta 1 \leq \delta \leq \beta 2$. This allows the nip R of the rubbing roller 400 to be at a position free from the influence of the inclination of the steering roller 132, allowing the roughening state on the inclination side and the non-inclination side of the fixing belt 105 to be uniform.

The second exemplary embodiment will be described.

Figure 20:
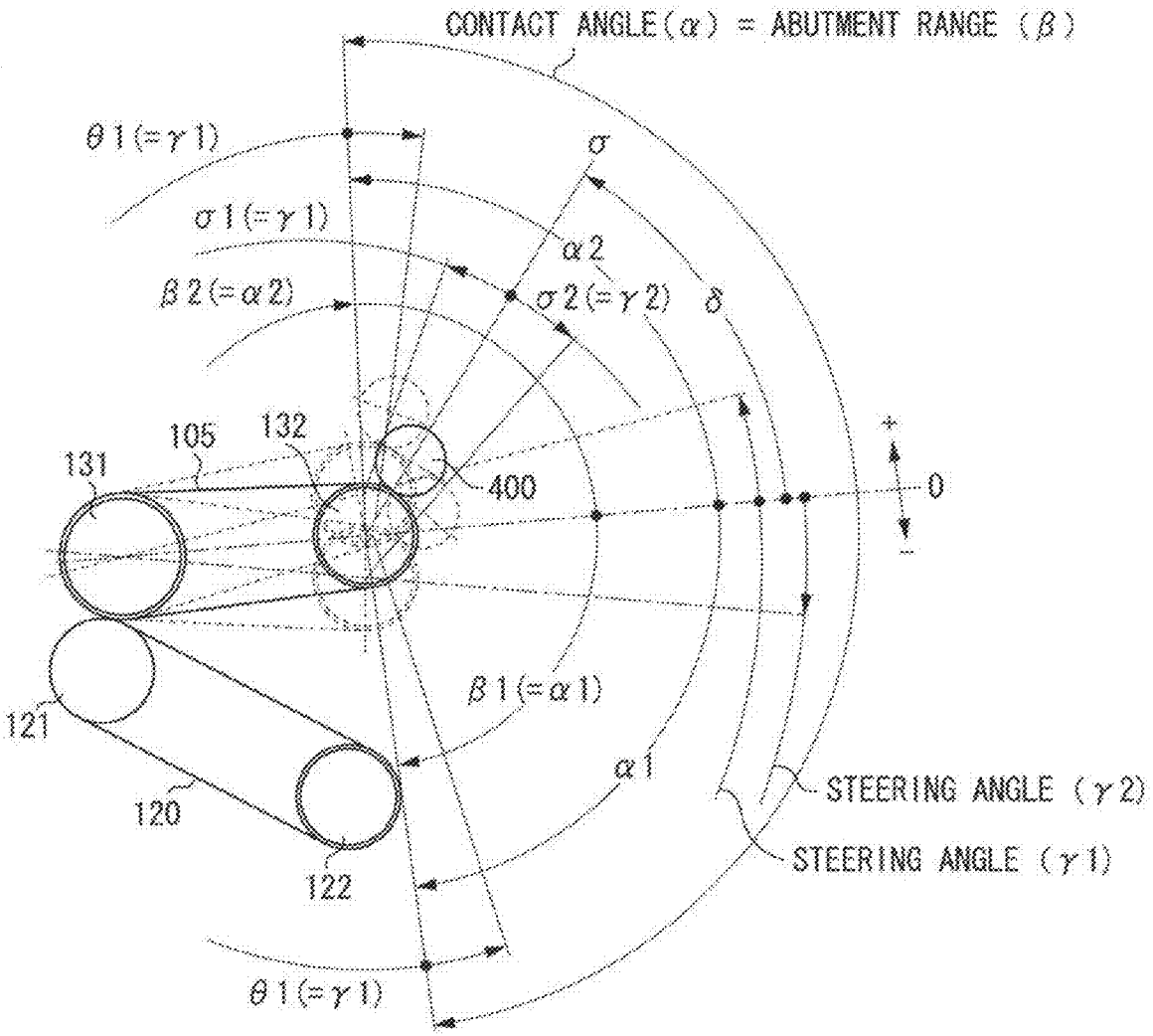
FIG. 20 is a schematic diagram illustrating the relationship between the inclined state of the fixing belt and the abutment position of the rubbing roller in the fixing device according to a second exemplary embodiment.

FIG. 20 is a schematic diagram illustrating the configuration of the fixing apparatus according to the second exemplary embodiment. The members of the same function as those described in the first exemplary embodiment are indicated by the same reference numerals, and unless necessary, a redundant description thereof will be left out.

In the present exemplary embodiment, the rubbing roller 400 is brought into contact with the steering roller 132 via the fixing belt 105. In a system for thus bringing the rubbing roller 400 into contact with the steering roller 132, which inclines, via the fixing belt 105, the rubbing roller 400 is inclined together with the steering roller 132, using the shaft of the steering roller 132 as the supporting point.

In other words, the rubbing roller 400 is brought into contact with the steering roller 132 while being supported so as to be integrally rotatable via the fixing belt 105. More specifically, a roughening member supporting unit for swingably supporting the rubbing roller 400 and urging the rubbing roller 400 toward the steering roller 132 via the fixing belt 105 is provided, so that the rubbing roller 400 abuts on the steering roller 132 while following the inclination of the steering roller 132.

The feature of this configuration lies in the fact that if the steering roller 132 inclines by the predetermined angle $\gamma 1$, the axis $\sigma$ also inclines to $\sigma 1$ by the same angle, so that the roughening nip R makes no relative movement from the abutment position at the neutral position.

If the steering roller 132 inclines by the predetermined angle $\gamma 1$, the position of the contact angle $\alpha$ moves to the roughening nip R side by the angle $\gamma 1$, whereby the boundary point of the contact angle of the fixing belt 105 moves by the angle $\theta 1$ ($=\gamma 1$) to the + side. At this time, since the axis $\sigma$ of the rubbing roller 400 also uses the shaft of the steering roller 132 as the supporting point, the axis $\sigma$ moves to the + side by $\sigma 1$ ($=\gamma 1$). In this way, $\theta 1=\sigma 1=\gamma 1$, which means all move by the same angle, so that there is no change in the relative angle among the steering roller 132, the rubbing roller 400, and the fixing belt 105 to become $\beta 1=\sigma 1$. By applying this to the formula, $\beta 1$ can be expressed as follows: $\beta 1=\alpha 1+\theta 1-\sigma 1$.

In the first exemplary embodiment, this formula cannot be expressed since $\sigma 1=0$. However, by substituting $\sigma 1=0$, the same formula as that of the first exemplary embodiment is attained, which means it is also applicable to the first exemplary embodiment.

Similarly, if the steering roller 132 inclines by the predetermined angle $\gamma 2$, there is no change in the relative angle among the steering roller 132, the rubbing roller 400, and the fixing belt 105. Accordingly, $\beta 2$ can be expressed as follows: $\beta 2=\alpha 2+\theta 2-\sigma 2$.

From the above, in the configuration of the second exemplary embodiment, with respect to $\beta 1$ and $\beta 2$ satisfying the formulas: $\beta 1=\alpha 1+\theta 1-\sigma 1$, and $\beta 2=\alpha 2+\theta 2-\sigma 2$, it is necessary for the angle $\delta$ of the axis $\sigma$ of the rubbing roller 400 to be arranged in the range satisfying the following relationship: $\beta 1 \leq \delta \leq \beta 2$.

The third exemplary embodiment will be described.

Figure 21A:
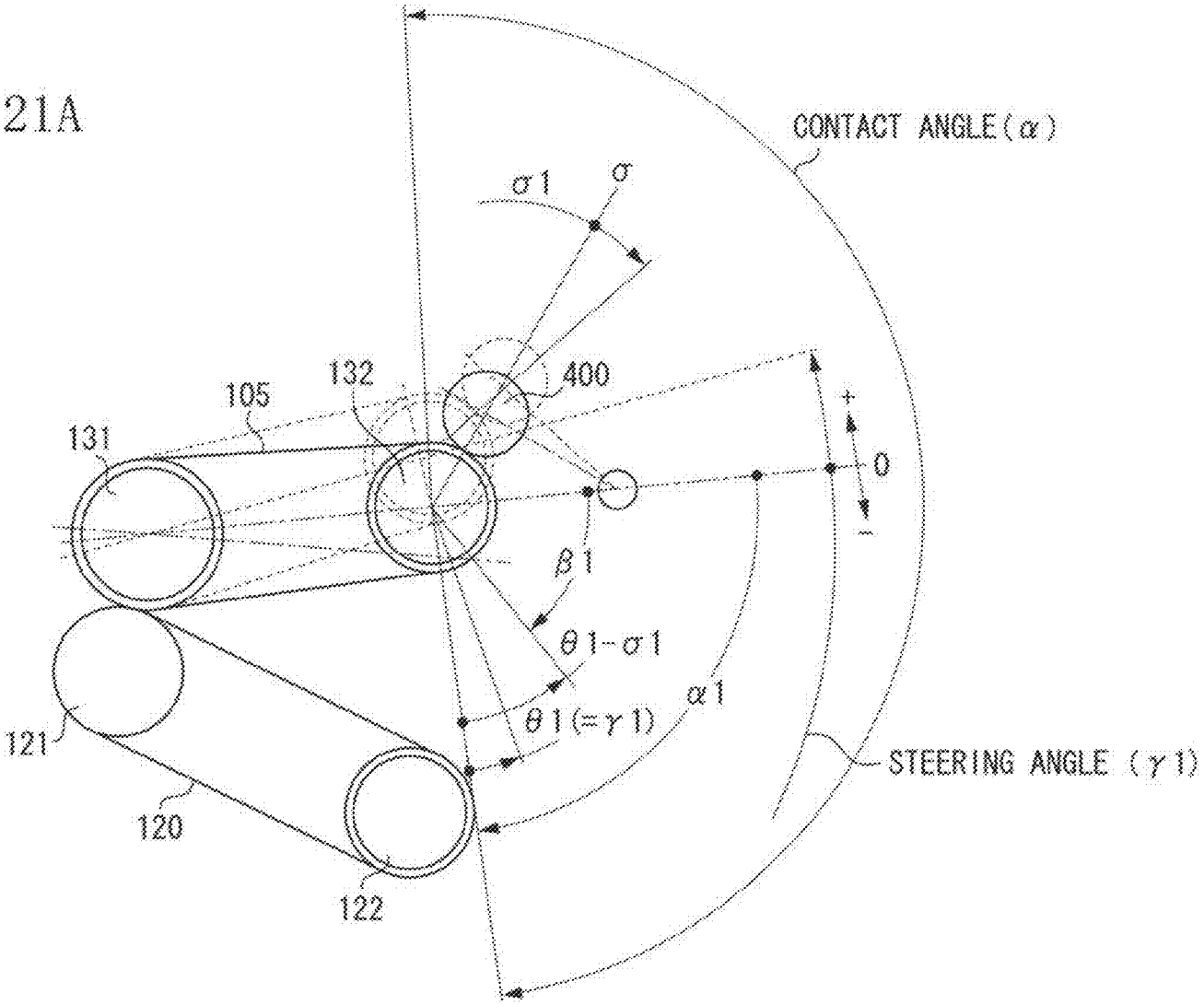
FIG. 21A is a schematic diagram illustrating the relationship between the inclined state of the fixing belt and the abutment position of the rubbing roller in the fixing device according to a third exemplary embodiment.
Figure 21B:
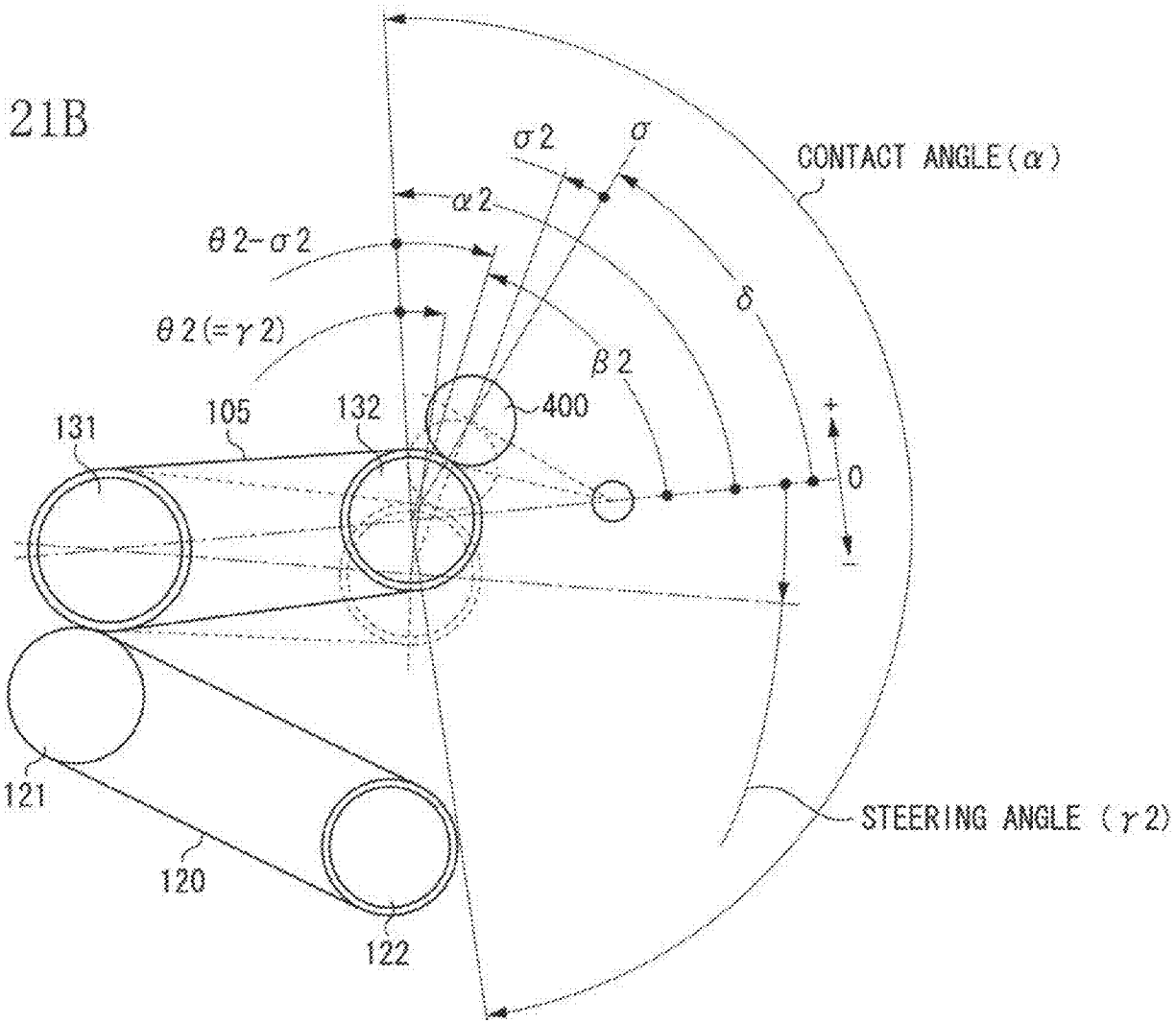
FIG. 21B is a schematic diagram illustrating the relationship between the inclined state of the fixing belt and the abutment position of the rubbing roller in the fixing device according to the third exemplary embodiment.

FIGS. 21A and 21B are schematic diagrams illustrating the construction of the fixing apparatus 100 according to the third exemplary embodiment. The members of the same function as those described in the first exemplary embodiment are indicated by the same reference numerals, and unless necessary, a redundant description thereof will be left out.

As in the second exemplary embodiment, in the fixing apparatus 100 according to the third exemplary embodiment, the rubbing roller 400 is brought into contact with the steering roller 132. The rubbing roller 400 can be brought into contact with the thus inclining steering roller 132 as follows. The rubbing roller 400 supported by the roughening member supporting unit having rotation centers in the right and left upper side-plates 140 of the apparatus main body, may be urged in the direction of the steering roller 132 by a spring or the like to be brought into contact with the same.

In this construction, as illustrated in FIG. 21A, if the steering roller 132 inclines by the predetermined angle $\gamma 1$, the axis $\sigma$ also inclines to $\sigma 1$. However, unlike the configuration of the second exemplary embodiment, the steering roller 132 and the rubbing roller 400 respectively incline in different directions.

If the steering roller 132 inclines by the predetermined angle $\gamma 1$, the position of the contact angle $\alpha$ moves to the nip R side by the angle $\gamma 1$, whereby the boundary point of the contact angle of the fixing belt 105 moves by the angle $\theta 1$ ($=\gamma 1$) to the + side. At this time, unlike the second exemplary embodiment, since there exists, for the axis $\sigma$ of the rubbing roller 400, another rotation center, the axis $\sigma$ moves to the − side by $\sigma 1$. Accordingly, $\beta 1$ is in the range excluding from $\alpha 1$ the movement by $\theta 1$ and $\sigma 1$. Thus, applying this to the formula, $\beta 1$ can be expressed as: $\beta 1=\alpha 1+\theta 1-\sigma 1$. Similarly, $\beta 2$ can be expressed as: $\beta 2=\alpha 2+\theta 2-\sigma 2$. FIG. 21B illustrates a case in which the steering roller 132 inclines by $\gamma 2$.

From the above, in the configuration of the third exemplary embodiment, with respect to $\beta 1$ and $\beta 2$ satisfying the formulas: $\beta 1=\alpha 1+\theta 1-\sigma 1$, and $\beta 2=\alpha 2+\theta 2-\sigma 2$, it is necessary for the angle $\delta$ of the axis $\sigma$ of the rubbing roller 400 to be arranged in the range satisfying the following relationship: $\beta 1 \leq \delta \leq \beta 2$.

The above formula is the same as that of the first and second exemplary embodiments. It can be seen that the above formula is to be employed irrespective of the abutment method and abutment position for the rubbing roller 400.

The fourth exemplary embodiment will be described.

Figure 22A:
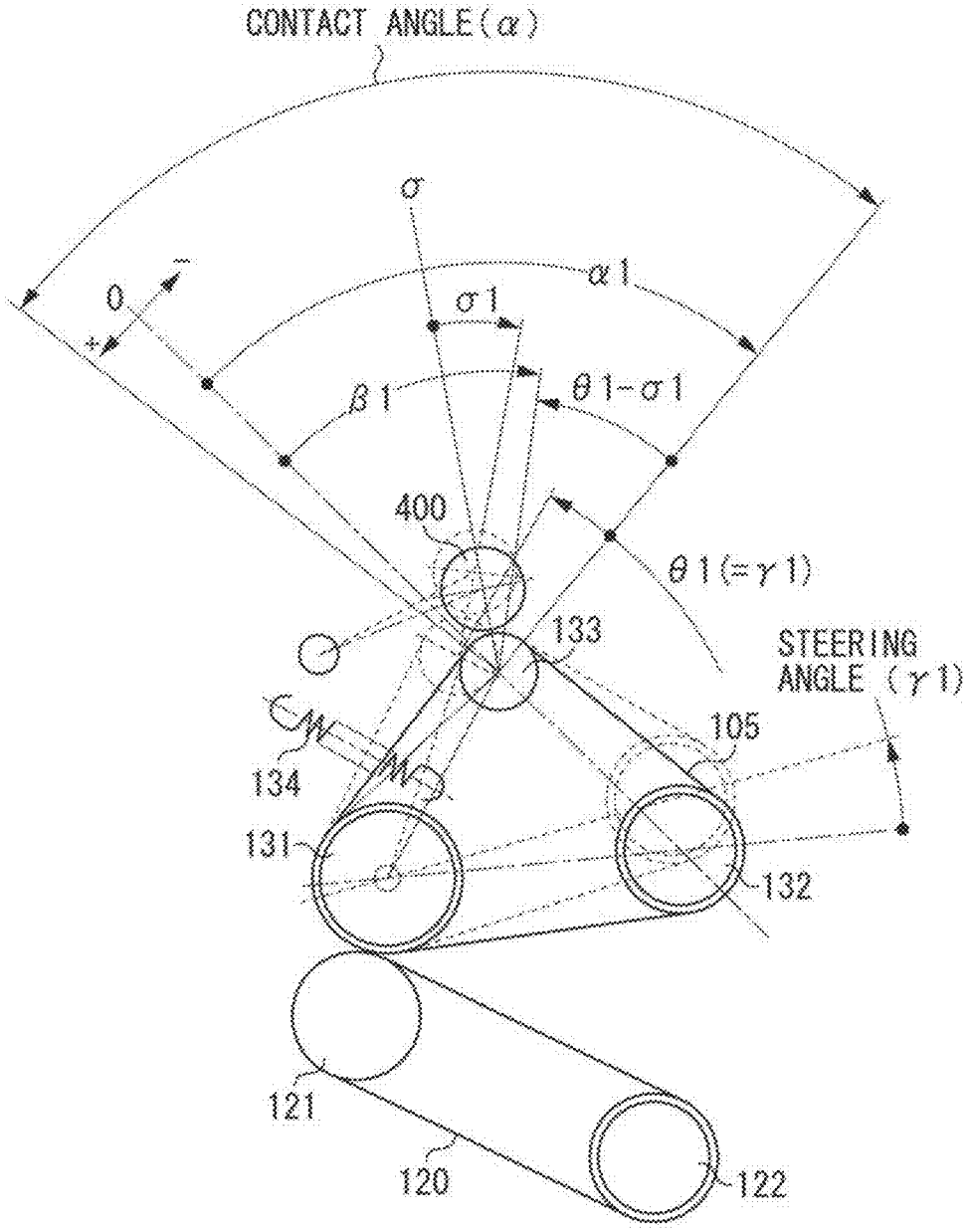
FIG. 22A is a schematic diagram illustrating the relationship between the inclined state of the fixing belt and the abutment position of the rubbing roller in the fixing device according to a fourth exemplary embodiment.
Figure 22B:
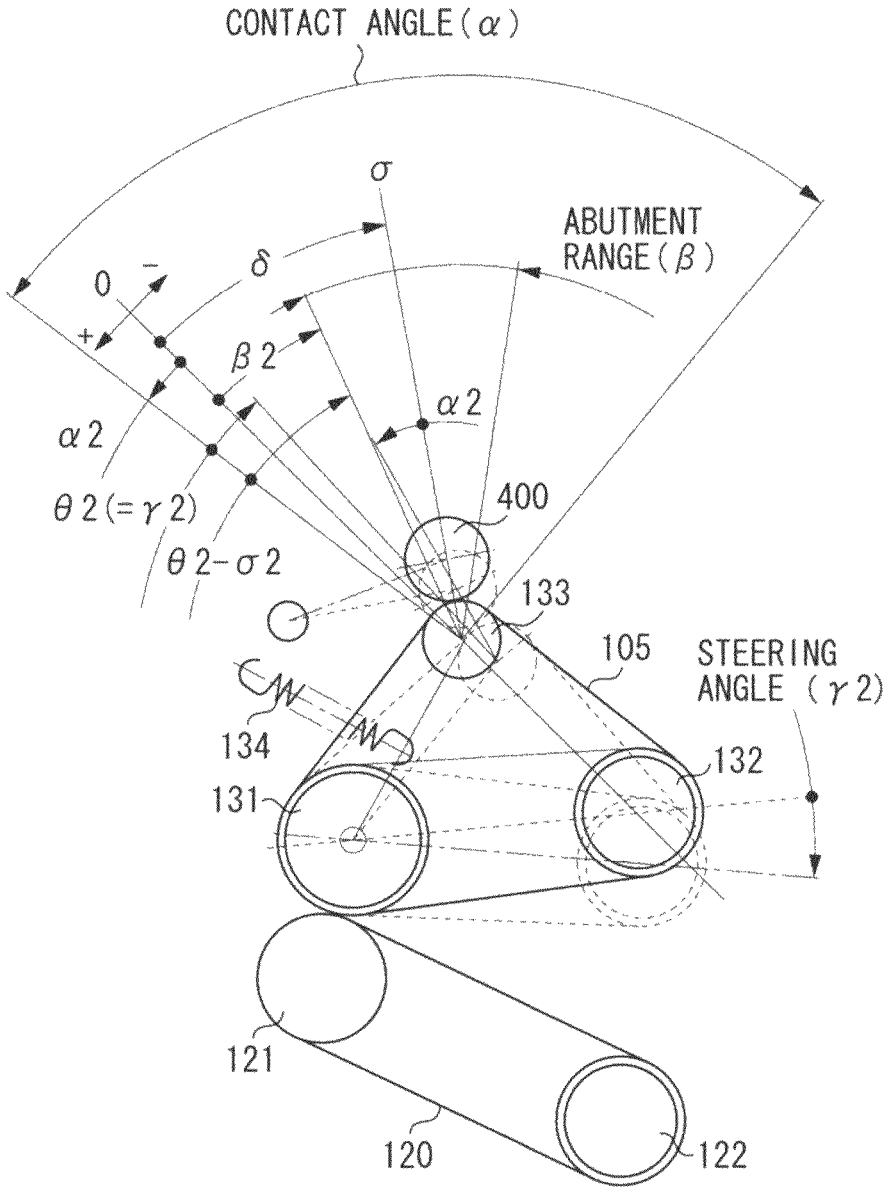
FIG. 22B is a schematic diagram illustrating the relationship between the inclined state of the fixing belt and the abutment position of the rubbing roller in the fixing device according to the fourth exemplary embodiment.

FIGS. 22A and 22B are schematic diagrams illustrating the configuration of the fixing apparatus 100 according to the fourth exemplary embodiment. The members of the same function as those described in the first exemplary embodiment are indicated by the same reference numerals, and unless necessary, a redundant description thereof will be left out.

A stretching roller (stretching rotary member) 133 is a roller formed of a solid stainless steel roller having an outer diameter of $\phi 20$ and configured to stretch the pressure belt 105. The stretching roller 133 uses, for example, the shaft of the drive roller 131 as the rotation center, and is arranged so as to impart a predetermined tension to the fixing belt 105 by a spring 134. As in the third exemplary embodiment, the rubbing roller 400 is supported by the roughening member supporting unit having rotation centers in the right and left upper side-plates 140 of the apparatus casing, and is urged in the direction of the stretching roller 133 to be brought into contact with the stretching roller 133 via the fixing belt 105.

The feature of this configuration lies in the fact that the rubbing roller 400 is brought into contact with the stretching roller 133 of the fixing belt 105 stretching by the three rollers 131, 132, and 133 via the fixing belt 105. Owing to the tension of the spring 134, the stretching roller 133 inclines in conjunction with the steering roller 132. In this process, as in the configuration of the third exemplary embodiment, the stretching roller 133 and the rubbing roller 400 respectively incline in different directions.

The first through third exemplary embodiments employ two rollers, so that the axis serving as the reference consists of an axis connecting the centers of the rollers, whereas, in the present exemplary embodiments, three rollers are employed. In this case, of the axis connecting the center of one of the rollers adjacent to the roller, with which the rubbing roller 400 is brought into contact, and the center of the roller, with which the rubbing roller 400 is brought into contact, the coordinate system prepared on the side of the roller, with which the rubbing roller 400 is brought into contact, serves as the reference 0.

As illustrated in FIG. 22A, if the steering roller 132 inclines by the predetermined angle $\gamma 1$, the position of the contact angle $\alpha$ moves to the nip R side by the angle $\gamma 1$, whereby the boundary point of the contact angle of the fixing belt 105 moves by the angle $\theta 1$ ($=\gamma 1$) to the + side. At this time, as in the third exemplary embodiment, the axis $\sigma$ of the rubbing roller 400 moves to the – side by $\sigma 1$. Accordingly, $\beta 1$ is in the range excluding from $\alpha 1$ the movement by $\theta 1$ and $\sigma 1$. Thus, applying this to the formula, $\beta 1$ can be expressed as: $\beta 1=\alpha 1+\theta 1-\sigma 1$. Similarly, $\beta 2$ can be expressed as: $\beta 2=\alpha 2+\theta 2-\sigma 2$. FIG. 22B illustrates a case in which the steering roller 132 inclines by $\gamma 2$.

From the above, in the configuration of the fourth exemplary embodiment, with respect to $\beta 1$ and $\beta 2$ satisfying the formulas: $\beta 1=\alpha 1+\theta 1-\sigma 1$, and $\beta 2=\alpha 2+\theta 2-\sigma 2$, it is necessary for the angle $\delta$ of the axis $\sigma$ of the rubbing roller 400 to be arranged in the range satisfying the following relationship: $\beta 1 \leq \delta \leq \beta 2$.

The above formula is the same as that of the first through third exemplary embodiments. It can be seen that the above formula is also to be applied to the swingable stretching roller 133 provided on the belt stretching by three rollers.

The fifth exemplary embodiment will be described.

Figure 23:
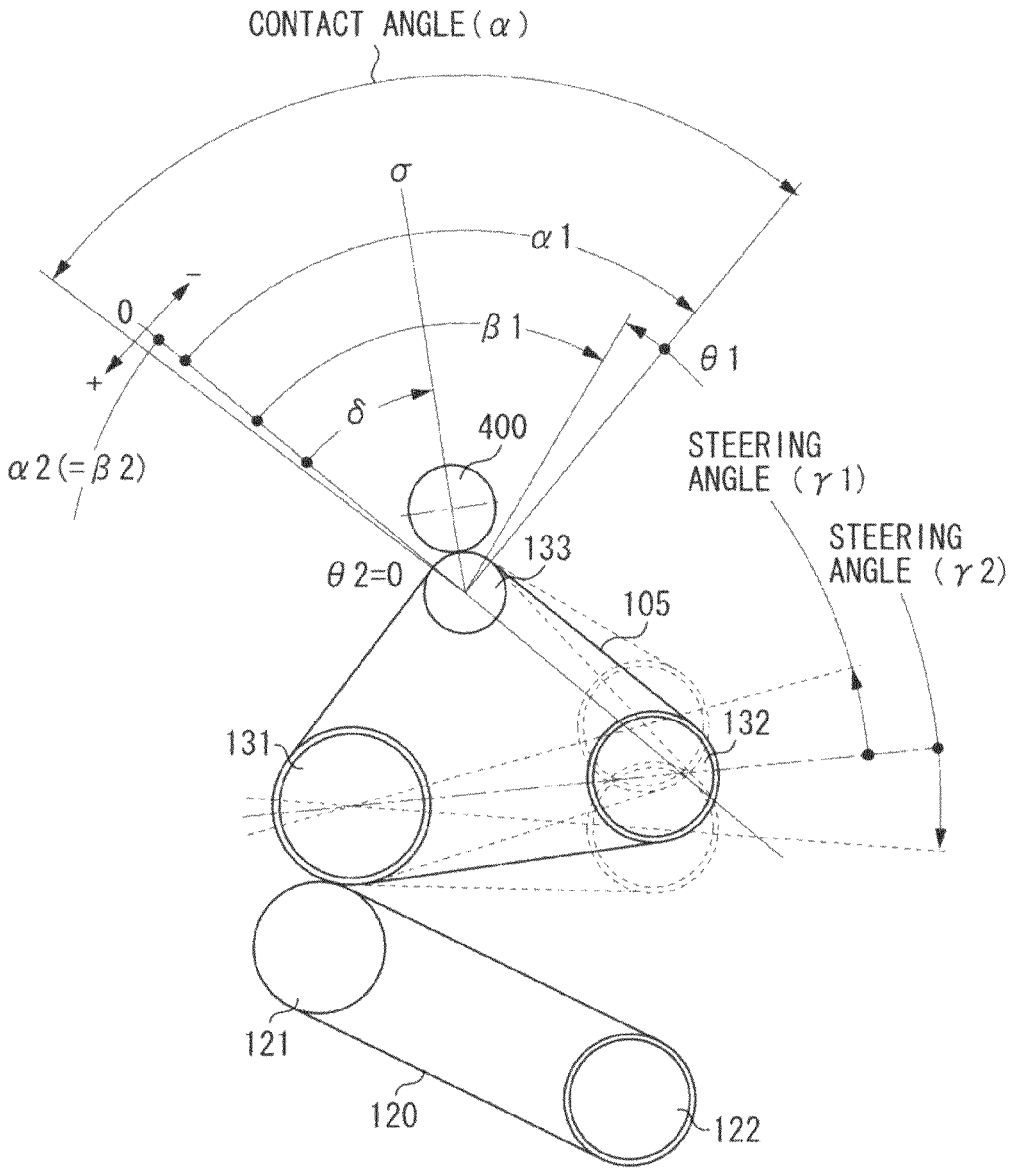
FIG. 23 is a schematic diagram illustrating the relationship between the inclined state of the fixing belt and the abutment position of the rubbing roller in the fixing device according to a fifth exemplary embodiment.

FIG. 23 is a schematic diagram illustrating the configuration of the fixing apparatus 100 according to the fifth exemplary embodiment. The members of the same function as those described in the first through fourth exemplary embodiments are indicated by the same reference numerals, and unless necessary, a redundant description thereof will be left out.

As in the fourth exemplary embodiment, in this configuration, the rubbing roller 400 is brought into contact with the stretching roller 133 of the fixing belt 105 stretched by the three rollers 131, 132, and 133 via the fixing belt 105. However, the present exemplary embodiment differs from the fourth exemplary embodiment in that the stretching roller 133 is rotatably retained on the right and left upper side-plates 140 of the apparatus casing via bearings. In this case, the reference axis is prepared in the same manner as in the fourth exemplary embodiment.

If the steering roller 132 inclines by the predetermined angle $\gamma 1$, the position of the contact angle $\alpha$ moves to the nip R side, whereby the boundary point of the contact angle of the fixing belt 105 moves by the angle $\theta 1$ ($=\gamma 1$) to the + side. However, in the case two rollers 131 and 132 are fixed in position as in the present fifth exemplary embodiment, the contact angle $\alpha$ on the drive roller 131 side does not move, and $\theta 1$ is not equal to $\gamma 1$ as in the first through fourth exemplary embodiments. Further, as in the first exemplary embodiment, the axis $\sigma$ of the rubbing roller 400 is a roller fixed in position as in the first exemplary embodiment, so that $\sigma 1=0$. Accordingly, the range of $\beta 1$ is a range obtained through exclusion of the amount of movement of $\theta 1$ from $\alpha 1$, so that, if the above formula is applied, $\beta 1$ can be expressed as follows: $\beta 1=\alpha 1+\theta 1$.

Further, even if the tension roller 132 inclines by the predetermined angle $\gamma 2$, the contact angle $\alpha$ on the drive roller 131 side does not move. Accordingly, $\theta 2=0$. Further, regarding the axis $\sigma$ of the rubbing roller 400, $\sigma 2=0$ since the roller is a stationary roller. Accordingly, $\beta 2$ remains the contact angle at the neural position, so that $\beta 2=\alpha 2$.

From the above, in the configuration of the fourth exemplary embodiment, with respect to $\beta 1$ and $\beta 2$ satisfying the formulas: $\beta 1=\alpha 1+\theta 1$, and $\beta 2=\alpha 2$, it is necessary for the angle $\delta$ of the axis $\sigma$ of the rubbing roller 400 to be arranged in the range satisfying the following relationship: $\beta 1 \leq \delta \leq \beta 2$.

This is the same as the above-described case, in which $\sigma=0$, $\sigma 2=0$, and $\theta 2=0$ are substituted in the above formulas: $\beta 1=\alpha 1+\theta 1-\sigma 1$, and $\beta 2=\alpha 2+\theta 2-\sigma 2$. Thus, it can be seen that the above formula is also applicable to the stationary type stretching roller 133 provided on the belt stretched by the three rollers 131, 132, and 133.

According to the fifth exemplary embodiment, in a case where the rubbing roller is brought into contact with an arbitrary roller of a plurality of rollers stretching the fixing belt so as to be opposite to the same, it is possible to attain the following effect even if the positional relationship between the rubbing roller and the contact angle of the fixing belt is changed by inclination of the steering roller. Specifically, it is always possible for the rubbing roller to abut on the range where the fixing belt is wrapped. As a result, it is possible to maintain uniform surface roughness for the fixing belt surface layer, allowing the recording material to maintain evenness in the gloss.

This is realized by arranging the rubbing roller 400 in the range satisfying the following relationship: $\beta 1 \leq \delta \leq \beta 2$ with respect to $\beta 1$ and $\beta 2$ satisfying the formulas: $\beta 1=\alpha 1+\theta 1$, and $\beta 2=\alpha 2$.

Although in the fourth and fifth exemplary embodiments the rubbing roller is brought into contact with the suspension roller 133 from among the three rollers, the present disclosure is also applicable to a case where the rubbing roller is brought into contact with the drive roller 131 and the tension roller 132.

Further, although in the present exemplary embodiment described above the fixing belt is stretched by three rollers, the present invention is also applicable if the number of stretching rollers is augmented. Further, although in the present exemplary embodiment described above the rubbing roller is brought into contact with the fixing belt, the present disclosure is also applicable to a case where the rubbing roller is brought into contact with the pressure belt of a fixing apparatus employing a pressure belt.

Other Items

Although in the present exemplary embodiment described above the rubbing roller 400 is brought into contact with the fixing belt 105, the present disclosure is also applicable to a case where the rubbing roller is brought into contact with the pressure belt of the fixing apparatus employing the pressure belt 120.

The pressure member (opposing member) may also be a roller member. Further, it may also be in the form of a non-rotary member such as a pad or a plate-shaped member in which the coefficient of friction of the surface, which is abutment surface abutting on the fixing belt 105 or the recording material, is small.

The use of the image heating apparatus according to the present invention is not restricted to the use as a fixing apparatus as described above. For example, it is also applicable to an image glossing apparatus configured to increase the gloss degree of an image once or temporarily fixed to a recording material (a fixed image or half-fixed image).

The pressure member 120 for forming the nip portion N in cooperation with the fixing belt 105 is not restricted to the belt as described above. It is also possible to employ a roller instead.

The heating mechanism for heating the belt 105 and the pressure member 120 is not restricted to an electromagnetic induction heating mechanism. For example, it is also possible to employ some other heating mechanism such as a halogen heater. In this case, it is advisable to arrange the halogen heater inside the drive roller (fixing roller) 131 or the pressure roller 121.

The image forming unit of the image forming apparatus is not restricted to an electrophotographic type. It may also be an electrostatic recording type or a magnetic recording type image forming unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-087254, filed Apr. 6, 2012, which is hereby incorporated by reference herein in its entirety.

What is claimed is:

1. A fixing apparatus comprising:

an endless belt configured to fix an unfixed toner image on a sheet at a nip portion by heat;

a first supporting roller and a second supporting roller configured to rotatably support an inner surface of the endless belt;

a rotary member configured to form the nip portion in cooperation with the endless belt;

a displacing mechanism configured to displace the first supporting roller so the endless belt is within a predetermined zone in a width direction of the endless belt; and a rubbing roller configured to rub an outer surface of the endless belt at a rubbing position where the rubbing roller causes the endless belt to be brought into press contact with the second supporting roller, wherein the rubbing position is a position that avoids a region where the endless belt is separated from the second supporting roller with a displacement of the first supporting roller.

2. The fixing apparatus according to claim 1, wherein the rubbing roller performs rubbing such that a surface roughness (Rz) of the outer surface of the endless belt becomes from 0.5 to 1.0.

3. The fixing apparatus according to claim 1, further comprising a moving mechanism configured to move the rubbing roller between the rubbing position and a separation position where the rubbing roller is separated from the endless belt, wherein if an image heating process is not being performed the moving mechanism moves the rubbing roller to the rubbing position in order to execute a rubbing process on the endless belt.

4. The fixing apparatus according to claim 3, wherein the rubbing position is a position that avoids the region where the endless belt is separated from the second supporting roller with the displacement of the first supporting roller at a time of state where the rubbing roller is at the separation position.

5. The fixing apparatus according to claim 3, wherein if the rubbing process on the endless belt is completed the moving mechanism moves the rubbing roller to the separation position.

6. The fixing apparatus according to claim 1, further comprising a moving mechanism configured to move the rotary member between an abutment position where the rotary member abuts on the endless belt and a separation position where the rotary member is separated from the endless belt, wherein if a rubbing process is being performed on the endless belt the moving mechanism moves the rotary member to the separation position.

7. The fixing apparatus according to claim 1, wherein the second supporting roller is provided to pinch the endless belt between the second supporting roller and the rotary member.

8. A fixing apparatus comprising:

an endless belt configured to fix an unfixed toner image on a sheet at a nip portion by heat;

a first supporting roller and a second supporting roller configured to rotatably support an inner surface of the endless belt;

a rotary member configured to form the nip portion in cooperation with the endless belt;

a displacing mechanism configured to displace the first supporting roller so the endless belt is within a predetermined zone in a width direction of the endless belt; and a rubbing roller configured to rub an outer surface of the endless belt at a rubbing position where the rubbing roller causes the endless belt to be brought into press contact with the second supporting roller, wherein the rubbing position is a position in a region where the endless belt is supported by the second supporting roller irrespective of a displacement operation of the first supporting roller.

9. The fixing apparatus according to claim 8, wherein the rubbing roller performs rubbing such that a surface roughness (Rz) of an outer surface of the endless belt ranges from 0.5 to 1.0.

10. The fixing apparatus according to claim 8, further comprising a moving mechanism configured to move the rubbing roller between the rubbing position and a separation position where the rubbing roller is separated from the endless belt, wherein if an image heating process is not being performed the moving mechanism moves the rubbing roller to the rubbing position in order to execute a rubbing process on the endless belt.

11. The fixing apparatus according to claim 10, wherein the rubbing position is a position in a region where the endless belt is supported by the second supporting roller irrespective of a displacement operation of the first supporting roller in a state where the rubbing roller is at the separation position.

12. The fixing apparatus according to claim 10, wherein if the rubbing process on the endless belt is completed the moving mechanism moves the rubbing roller to the separation position.

13. The fixing apparatus according to claim 8, further comprising a moving mechanism configured to move the rotary member between an abutment position where the rotary member abuts on the endless belt and a separation position where the rotary member is separated from the endless belt, wherein if a rubbing process is being performed on the endless belt the moving mechanism moves the rotary member to the separation position.

14. The fixing apparatus according to claim 8, wherein the second supporting roller is provided to pinch the endless belt between the second supporting roller and the rotary member.

15. An image heating apparatus includes:

an endless belt configured to heat a toner image on a sheet at a nip portion;

a first supporting roller and a second supporting roller configured to rotatably support an inner surface of the endless belt;

a rotary member configured to form the nip portion in cooperation with the endless belt;

a displacing mechanism configured to displace the first supporting roller in a predetermined range from a first position to a second position so that the endless belt is within a predetermined zone in a width direction of the endless belt;

a rubbing roller configured to rub an outer surface of the endless belt at a rubbing position where the rubbing roller causes the endless belt to be brought into press contact with the second supporting roller; and a moving mechanism configured to move the rubbing roller between the rubbing position and a separation position where the rubbing roller is separated from the endless belt, wherein the rubbing position is a position that avoids a region where the endless belt is separated from the second supporting roller in a case where the first supporting roller is in the first position and the second position in a state where the rubbing roller is in the separation position.

16. The image heating apparatus according to claim 15, wherein the rubbing roller performs rubbing such that the surface roughness (Rz) of the outer surface of the endless belt ranges from 0.5 to 1.0.

17. An image heating apparatus comprising:

an endless belt configured to heat a toner image on a sheet at a nip portion;

a first supporting roller and a second supporting roller configured to rotatably support an inner surface of the endless belt;

a rotary member configured to form the nip portion in cooperation with the endless belt;

a displacing mechanism configured to displace the first supporting roller in a predetermined range from a first position to a second position so that the endless belt is within a predetermined zone in a width direction of the endless belt; and a rubbing roller configured to rub an outer surface of the endless belt at a rubbing position where the rubbing roller causes the endless belt to be brought into press contact with the second supporting roller, wherein the rubbing position is a position in a region where the endless belt is supported by the second supporting roller in a case where the first supporting roller is in the first position and the second position in a state where the rubbing roller is in the separation position.

18. The image heating apparatus according to claim 17, wherein the rubbing roller performs rubbing such that the surface roughness (Rz) of an outer surface of the endless belt ranges from 0.5 to 1.0.

* * * * *